US009065166B2

(12) United States Patent
Ng et al.

(10) Patent No.: US 9,065,166 B2
(45) Date of Patent: Jun. 23, 2015

(54) MULTI-BAND PLANAR INVERTED-F (PIFA) ANTENNAS AND SYSTEMS WITH IMPROVED ISOLATION

(71) Applicant: Laird Technologies, Inc., Earth City, MO (US)

(72) Inventors: Kok Jiunn Ng, Penang (MY); Ee Wei Sim, Penang (MY); Joshua Ooi Tze Meng, Selangor Darul Ehsan (MY)

(73) Assignee: Laird Technologies, Inc., Earth City, MO (US)

( * ) Notice: Subject to any disclaimer, the term of this patent is extended or adjusted under 35 U.S.C. 154(b) by 0 days.

(21) Appl. No.: 14/331,829

(22) Filed: Jul. 15, 2014

(65) Prior Publication Data

US 2014/0320363 A1 Oct. 30, 2014

Related U.S. Application Data

(63) Continuation of application No. 13/988,163, filed as application No. PCT/MY2011/000014 on Feb. 18, 2011.

(51) Int. Cl.
*H01Q 19/10* (2006.01)
*H01Q 5/00* (2015.01)
(Continued)

(52) U.S. Cl.
CPC ..... *H01Q 5/0024* (2013.01); *H01Q 9/0421* (2013.01); *H01Q 21/28* (2013.01);
(Continued)

(58) Field of Classification Search
CPC ..... H01Q 19/10
USPC ..... 343/770
See application file for complete search history.

(56) References Cited

U.S. PATENT DOCUMENTS 5,952,983 A 9/1999 Dearnley et al.
6,950,068 B2 9/2005 Bordi et al.
(Continued)

FOREIGN PATENT DOCUMENTS

CN 1742406 3/2006
CN 1894825 1/2007
(Continued)

OTHER PUBLICATIONS

Taiwan Office Action dated Oct. 27, 2014 for Taiwan application No. 100147688 (published as TW201248995) which claims priority to the same parent application as the instant application; 8 pages.
(Continued)

*Primary Examiner* — Dameon E Levi
*Assistant Examiner* — Andrea Lindgren Baltzell
(74) *Attorney, Agent, or Firm* — Harness, Dickey & Pierce, P.L.C.

(57) ABSTRACT

Exemplary embodiments are provided of multi-band Planar Inverted-F antennas and antenna systems including the same. In an exemplary embodiment, a Planar Inverted-F antenna (PIFA) generally includes a planar radiator or upper radiating patch element having a slot. A lower surface of the PIFA is spaced apart from the upper radiating patch element. First and second shorting elements electrically connect the planar radiator to the lower surface. The PIFA also includes a feeding element electrically connected between the upper radiating patch element and the lower surface. The PIFA may be mounted on a ground plane that is larger than the lower surface of the PIFA.

20 Claims, 16 Drawing Sheets

(51) Int. Cl.

| | |
|---|---|
| ***H01Q 9/04*** | (2006.01) |
| ***H01Q 21/28*** | (2006.01) |
| ***H01Q 1/52*** | (2006.01) |
| ***H01Q 13/10*** | (2006.01) |
| ***H01Q 5/30*** | (2015.01) |
| ***H01Q 5/357*** | (2015.01) |
| ***H01Q 5/364*** | (2015.01) |

(52) U.S. Cl.

CPC ..... *H01Q 1/523* (2013.01); *H01Q 13/106* (2013.01); *H01Q 1/521* (2013.01); *H01Q 1/526* (2013.01); *H01Q 5/30* (2015.01); *H01Q 5/357* (2015.01); *H01Q 5/364* (2015.01)

(56) References Cited

U.S. PATENT DOCUMENTS

| | | | | |
|---|---|---|---|---|
| 7,414,583 | B2 | 8/2008 | Choi et al. | |
| 2002/0140607 | A1* | 10/2002 | Zhou | 343/700 MS |
| 2003/0193437 | A1* | 10/2003 | Kangasvieri et al. | 343/702 |
| 2004/0070537 | A1 | 4/2004 | Kadambi et al. | |
| 2004/0085244 | A1 | 5/2004 | Kadambi et al. | |
| 2006/0012524 | A1 | 1/2006 | Mierke et al. | |
| 2006/0145924 | A1 | 7/2006 | Chen et al. | |
| 2007/0046543 | A1 | 3/2007 | Choi et al. | |
| 2007/0120740 | A1 | 5/2007 | Iellici et al. | |
| 2009/0174611 | A1* | 7/2009 | Schlub et al. | 343/702 |
| 2010/0045534 | A1 | 2/2010 | Tsai et al. | |
| 2012/0169550 | A1 | 7/2012 | Schlub et al. | |

FOREIGN PATENT DOCUMENTS

| | | |
|---|---|---|
| CN | 201430211 | 3/2010 |
| CN | 103348532 | 10/2013 |
| DE | 10147921 | 4/2003 |
| EP | 1315238 | 5/2003 |
| EP | 1351334 | 10/2003 |
| EP | 1453140 | 9/2004 |
| EP | 2099093 | 9/2009 |
| EP | 2676324 | 2/2013 |
| KR | 10-2006-0064473 | 6/2006 |
| KR | 10-0807299 | 2/2008 |
| KR | 10-2009-0093120 | 9/2009 |
| WO | WO 01/33665 | 5/2001 |
| WO | WO 2012/112022 | 8/2012 |

OTHER PUBLICATIONS

International Search Report dated Aug. 1, 2011 for PCT/MY2011/000014 (published as WO 2012/112022); 6 pages. The instant application is a national phase application from PCT/MY2011/000014.

PCT Written Opinion dated Aug. 1, 2011 for PCT/MY2011/000014 (published as WO2012/112022); 6 pgs. The instant application is a national phase application of PCT/MY2011/000014.

European Search Report from European application No. 11858897 (now published as EP2676324) which claims priority to the same parent application as the instant application; dated Sep. 18, 2014; 8 pages.

Chinese Office Action from Chinese application No. 201180066681.6 (now published as CN103348532) which claims priority to the same parent application as the instant application; dated Aug. 5, 2014; 11 pages.

* cited by examiner

MULTI-BAND PLANAR INVERTED-F (PIFA) ANTENNAS AND SYSTEMS WITH IMPROVED ISOLATION

CROSS-REFERENCE TO RELATED APPLICATIONS

This application is a continuation of U.S. patent application Ser. No. 13/988,163 filed May 17, 2013, which is a national phase of PCT Patent Application No. PCT/MY2011/000014 filed Feb. 18, 2011. The entire disclosures of the above applications are incorporated herein by reference.

FIELD

The present disclosure generally relates to multi-band Planar Inverted-F Antennas (PIFAs) with improved and/or good isolation, which are suitable for multi-antenna applications that use more than one antenna.

BACKGROUND

This section provides background information related to the present disclosure which is not necessarily prior art.

Examples of infrastructure antenna systems include customer premises equipment (CPE), satellite navigation systems, alarm systems, terminal stations, central stations, and in-building antenna systems. With the fast growing technologies, antenna bandwidth has become a great challenge along with the requirement to miniaturize CPE device size or antenna system size in order to maintain a low profile. In addition, multi-antenna systems having more than one antenna have been used to increase capacity, coverage, and cell throughput.

Also with the fast growing technologies, many devices have gone to multiple antennas in order to satisfy the end customers' demand. For example, multiple antennas are used in multiple input multiple output (MIMO) applications in order to increase user capacity, coverage, and cell throughput. With the current market trend towards economical, small, and compact devices, it is not uncommon to use multiple antennas identical in form that are placed in very close proximity to each other due to size and space limitations. Moreover, antennas for customer premises equipment, terminal stations, central stations, or in-building antenna systems must usually be low profile, light in weight, and compact in physical volume, which makes PIFAs particularly attractive for these types of applications.

FIG. 1 illustrates a conventional Planar Inverted F-Antenna (PIFA) 10. As shown in FIG. 1, this basic design consists of a radiating patch element 12, a ground plane 14, a shorting element 16, and a feeding element 18. The width and length of the radiating patch element 12 determine the desired frequency resonant. The summation of the width and length of the radiating patch element 12 is about one quarter wavelength ($\lambda/4$). The radiating patch element 12 may be supported by a dielectric substrate above the ground plane 14.

SUMMARY

This section provides a general summary of the disclosure, and is not a comprehensive disclosure of its full scope or all of its features.

According to various aspects, exemplary embodiments are disclosed of multi-band Planar Inverted-F antennas (PIFAs) and antenna systems including the same. In an exemplary embodiment, a PIFA generally includes a planar radiator or upper radiating patch element having a slot.

Another exemplary embodiment includes an antenna system operable within at least a first frequency range and a second frequency range different than the first frequency range. In this embodiment, the system generally includes a ground plane and first and second planar inverted-F antennas (PIFAs). Each PIFA includes a planar radiator having a slot and a lower surface spaced apart from the planar radiator, which is also mechanically and electrically connected to the ground plane. First and second shorting elements electrically connect the planar radiator to the lower surface of each PIFA. Also, a feeding element is electrically connected between the upper radiating patch element and the lower surface of each PIFA. The system may also include a first isolator disposed between the first and second PIFAs, and a second isolator extending outwardly from the ground plane.

In a further exemplary embodiment, there is an antenna system operable within at least a first frequency range and a second frequency range different than the first frequency range. In this example, the system generally includes a ground plane, first and second PIFAs, and first and second isolators. The first isolator includes a vertical wall portion disposed between first and second PIFAs such that the first and second PIFAs are symmetrically arranged about and spaced equidistant from opposite sides of the first isolator. The second isolator includes a first portion extending outwardly from the ground plane and a second portion generally parallel to the ground plane.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6:
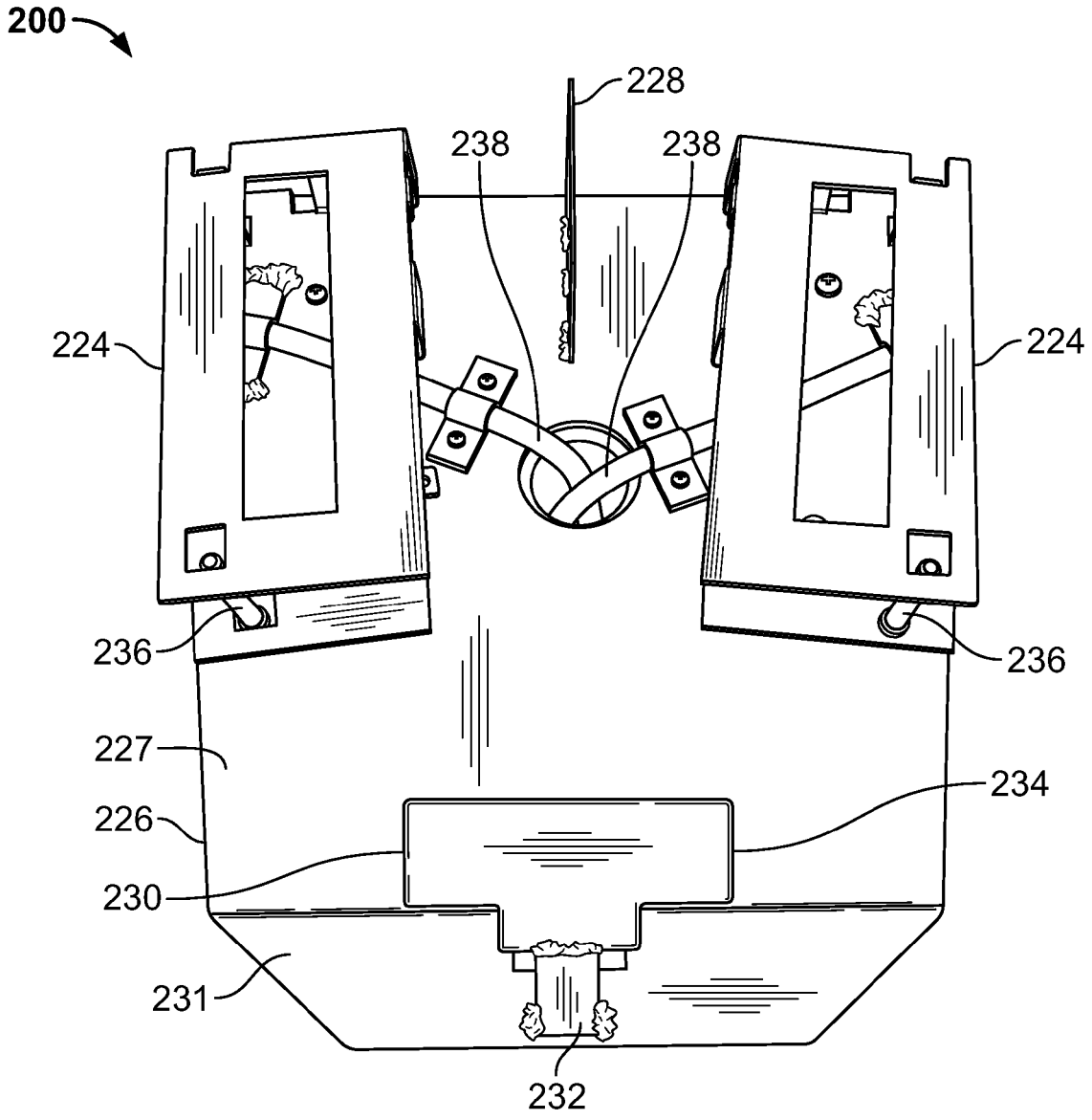
FIG. 6 is a perspective view of an exemplary antenna system that includes two of the multi-band PIFAs shown in FIG. 2 through FIG. 5, a vertical wall isolator, and a spoiler-shaped/T-shaped isolator on a ground plane according to an exemplary embodiment.
Figure 7:
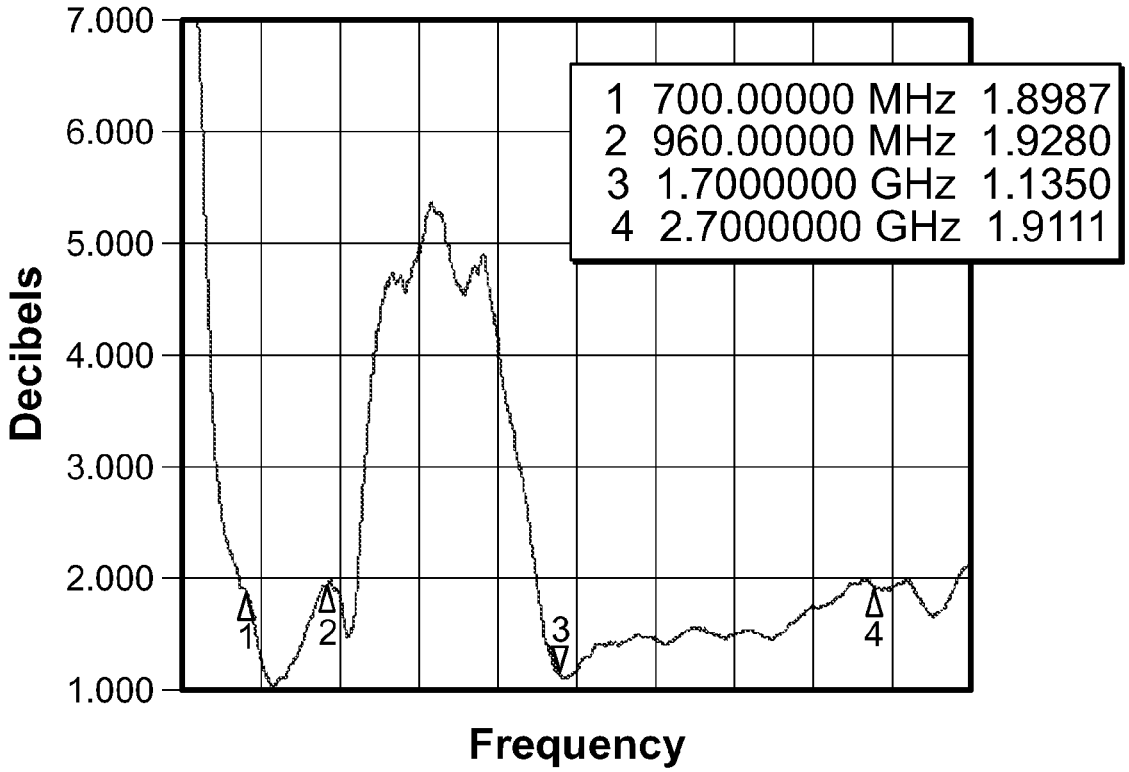
FIG. 7 is an exemplary line graph illustrating Voltage Standing Wave Ratio (VSWR) versus frequency measured for one of the multi-band PIFAs of a prototype of the example antenna system shown in FIG. 6.
Figure 8:
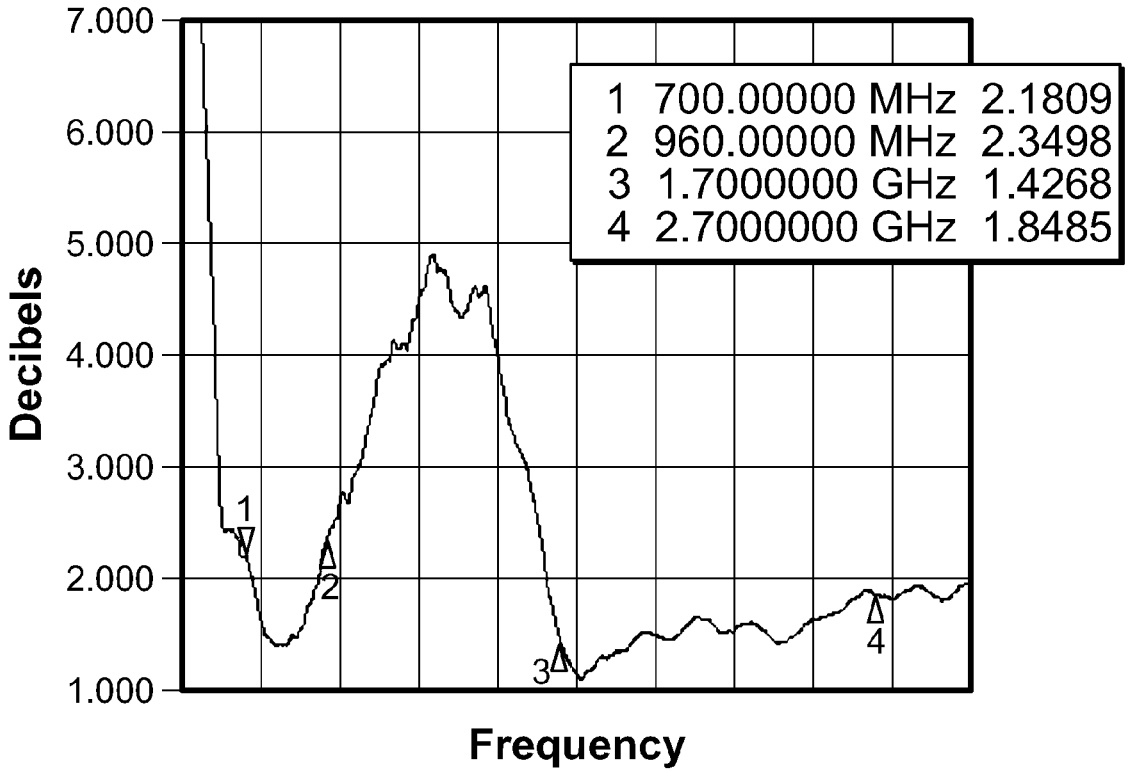
Figure 9:
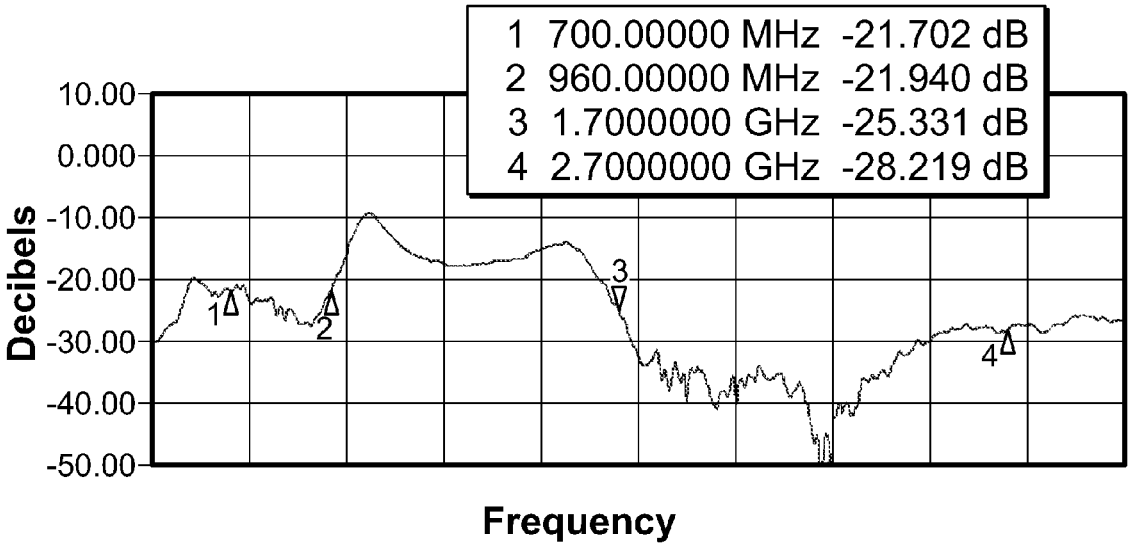
Figure 10:
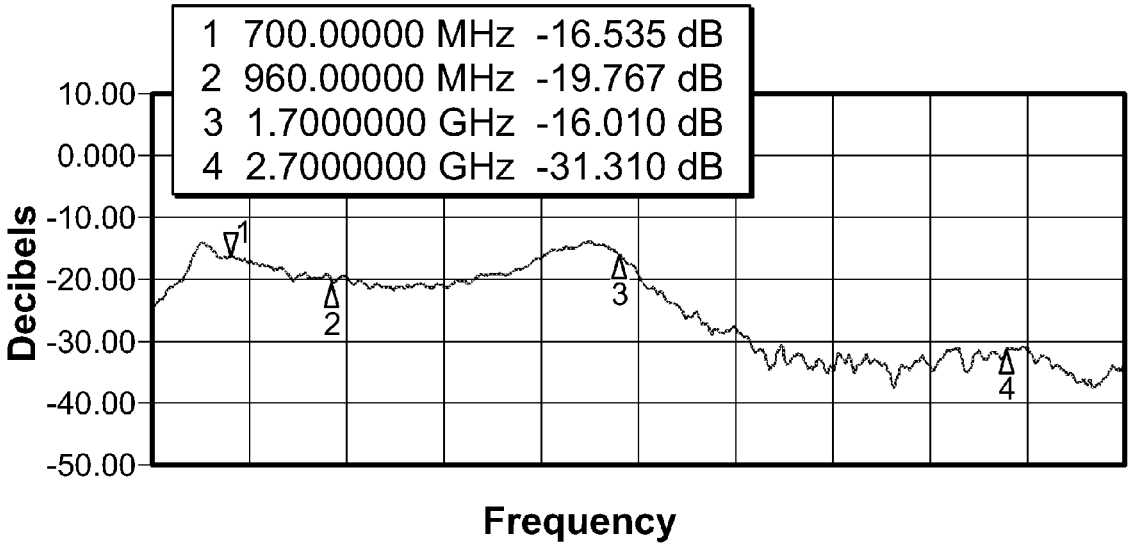
Figure 11:
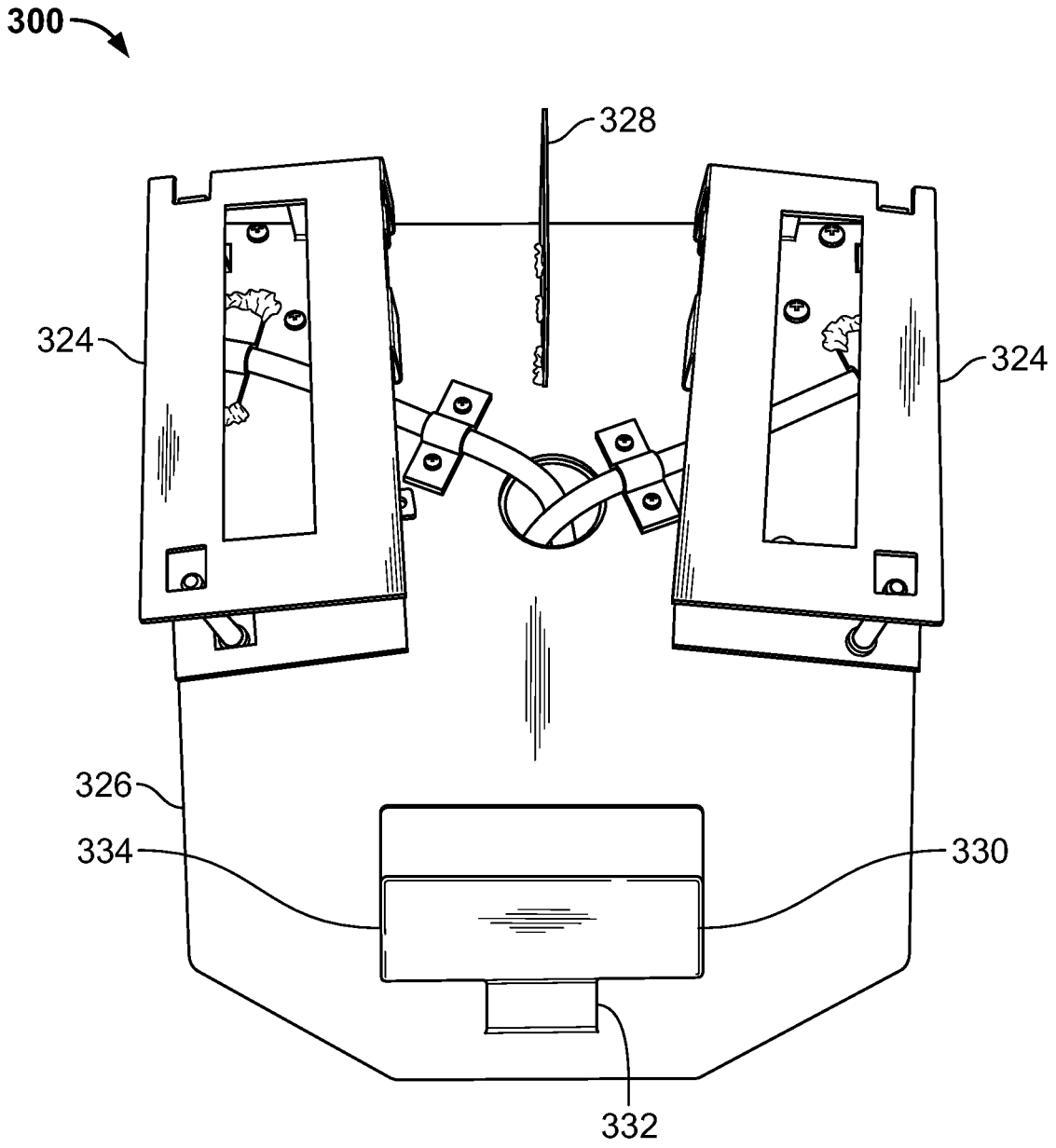
Figure 12:
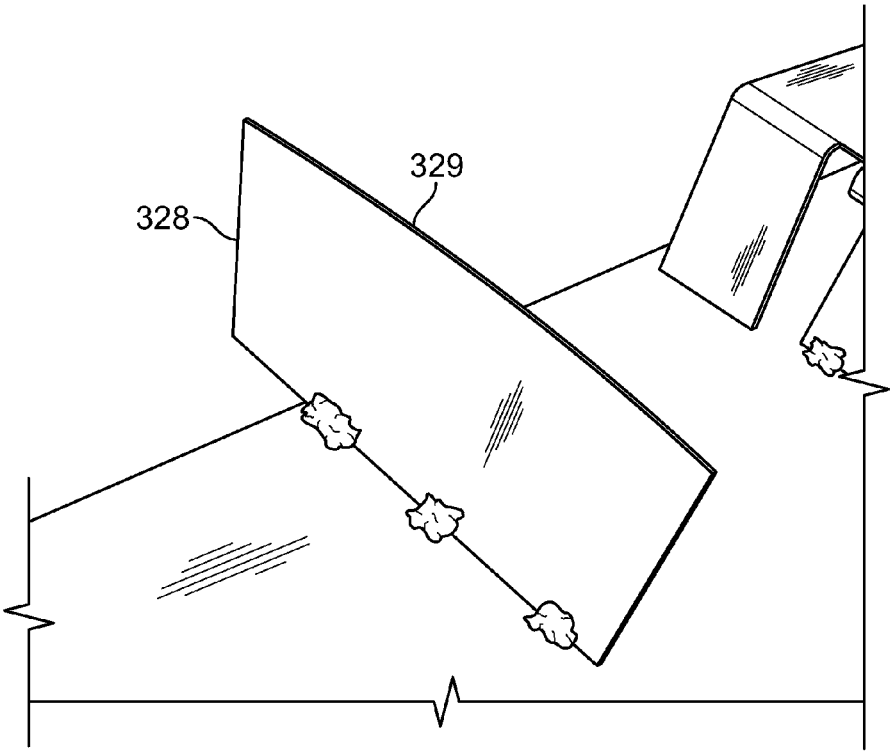
Figure 13:
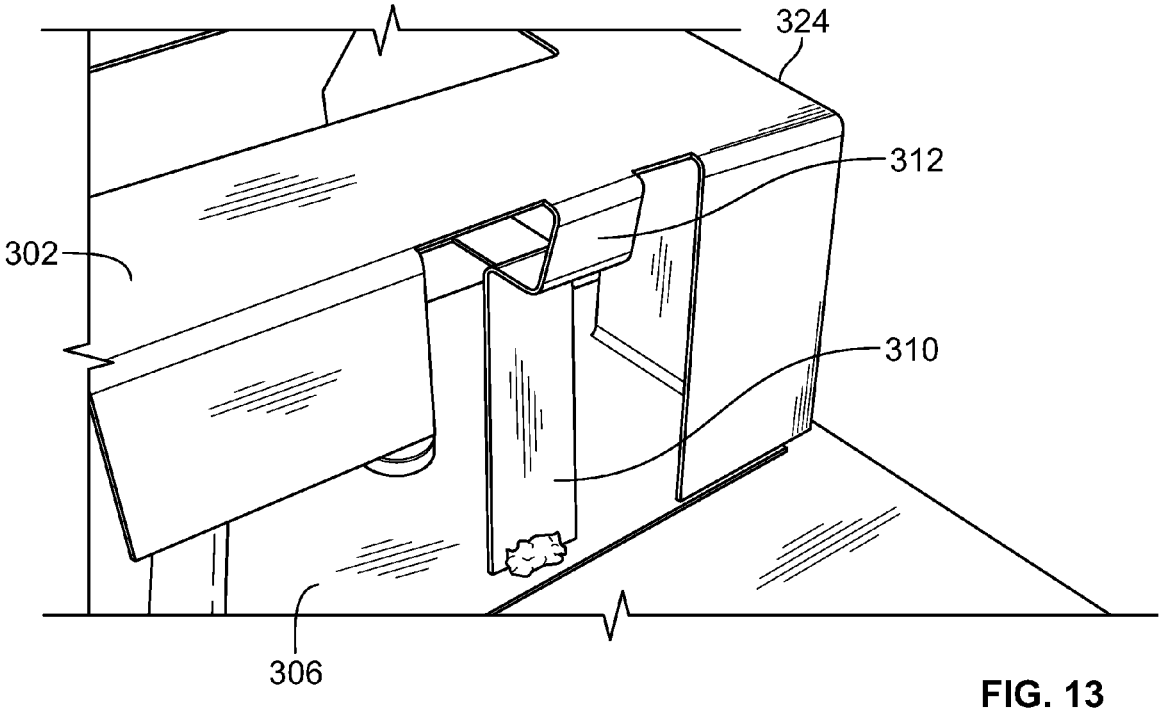
Figure 14:
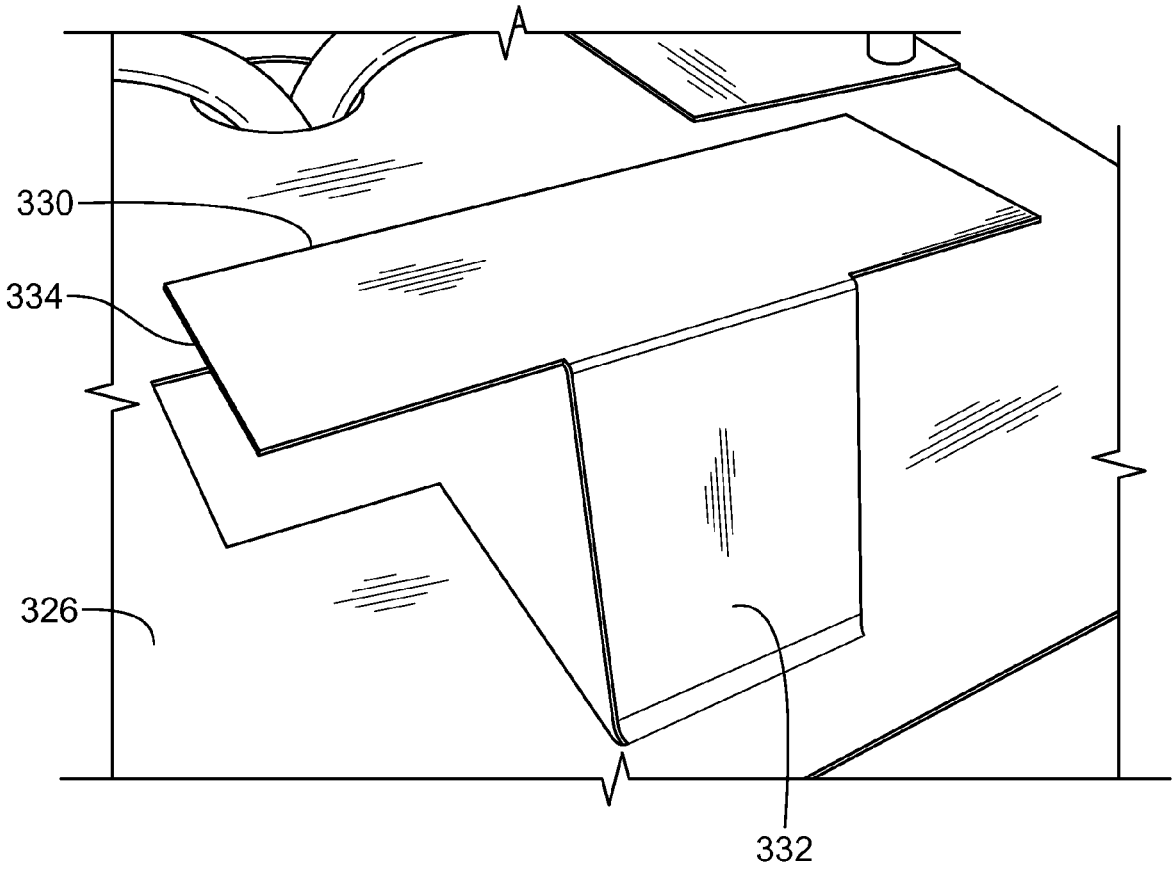
Figure 15:
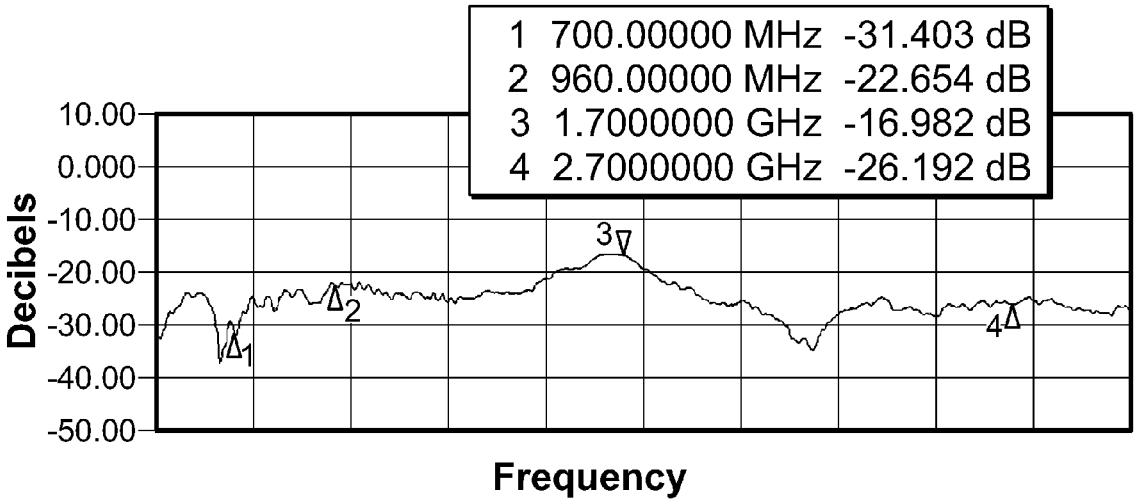
Figure 16:
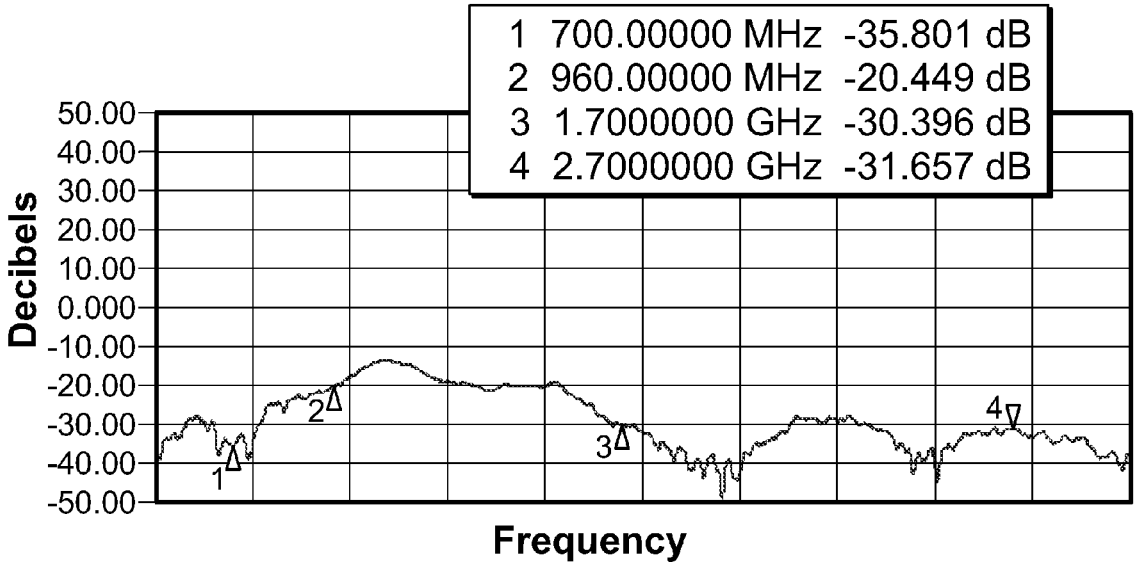
Figure 18:
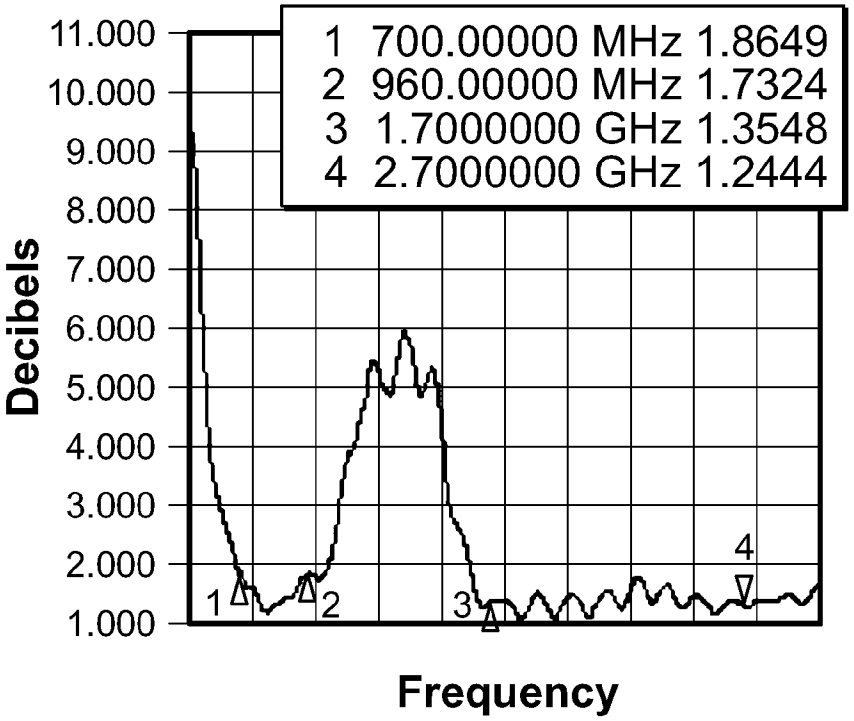
Figure 17:
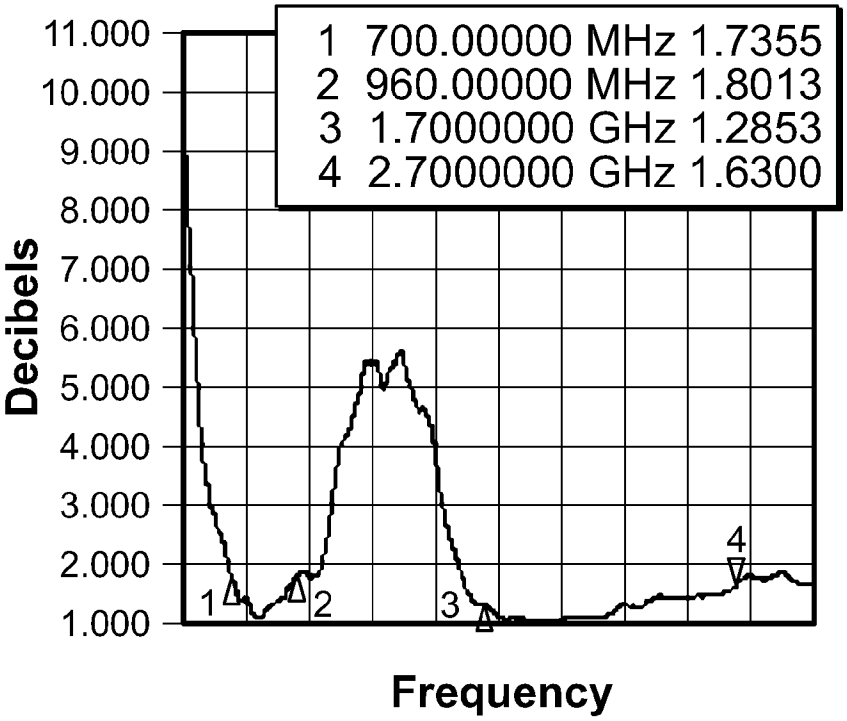
Figure 20:
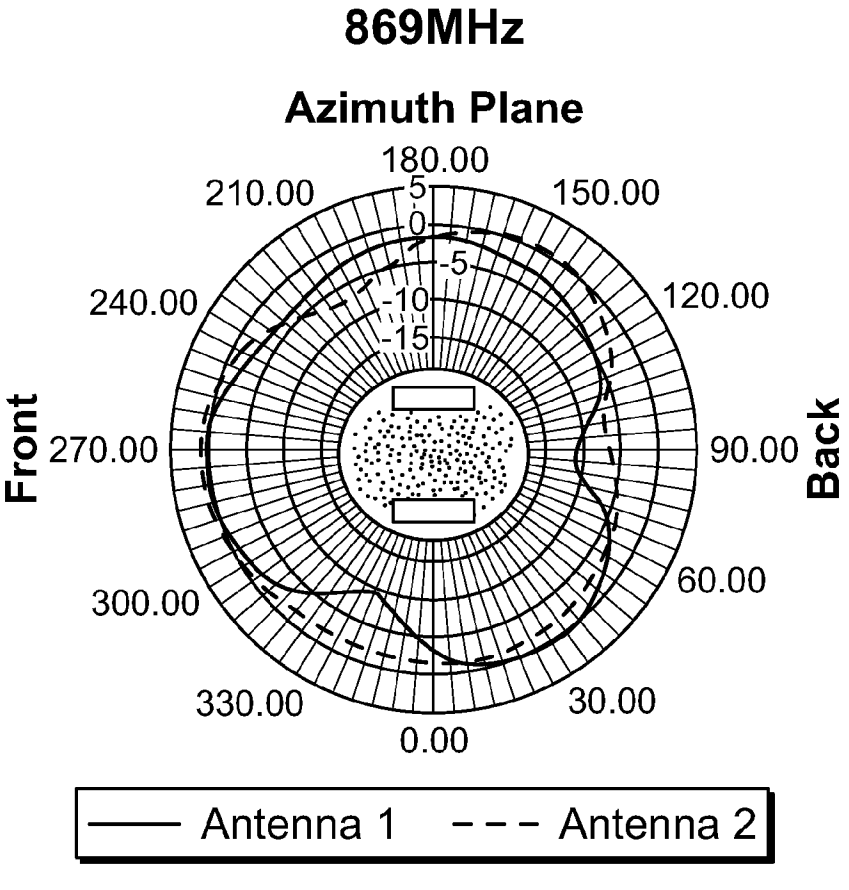
Figure 19:
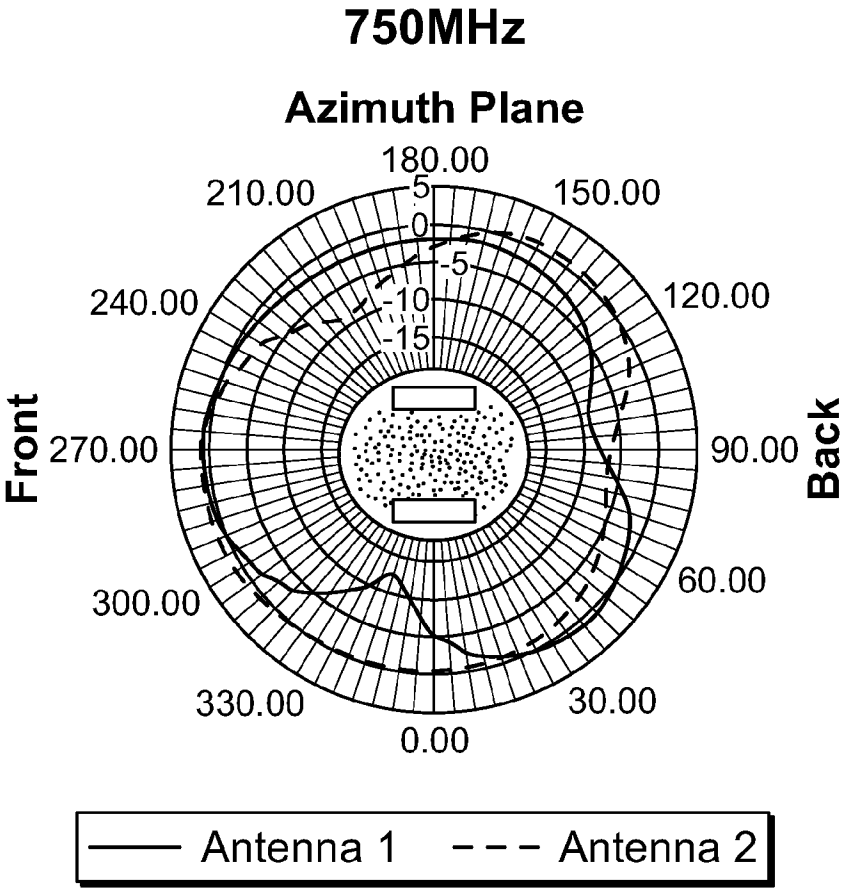
Figure 22:
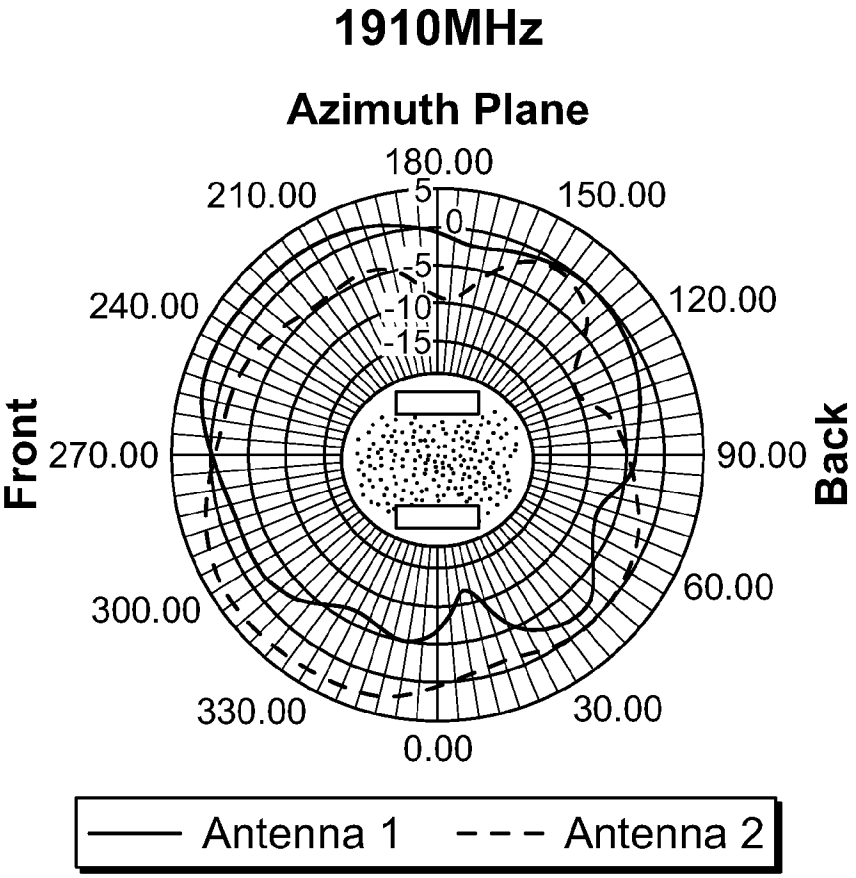
Figure 21:
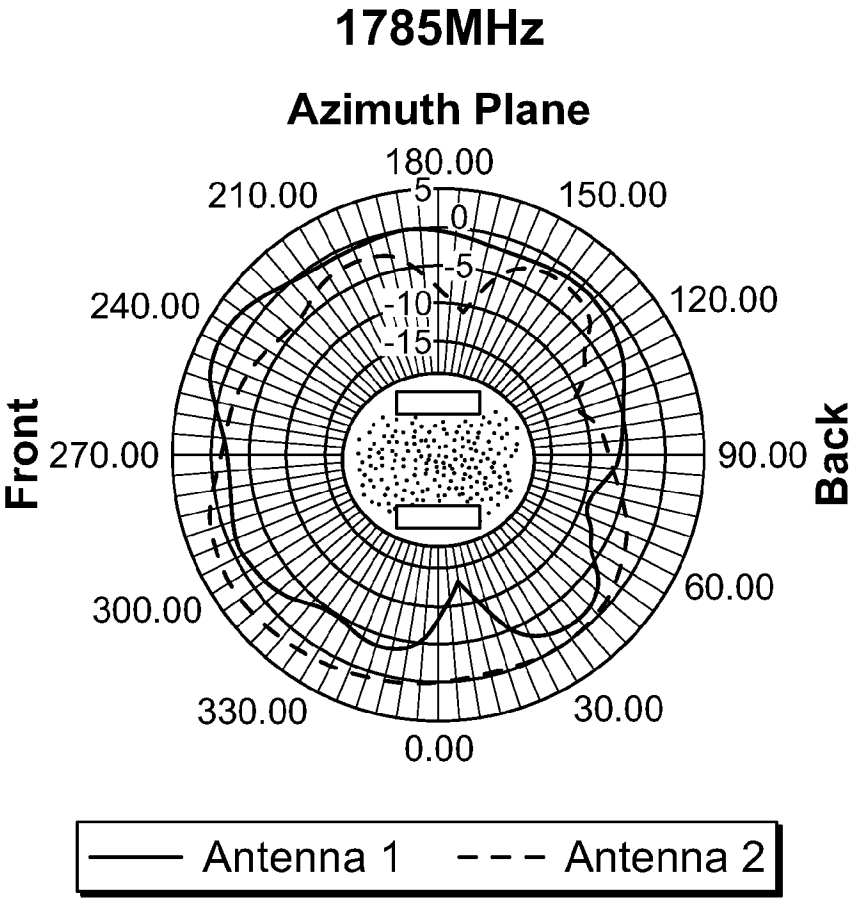
Figure 24:
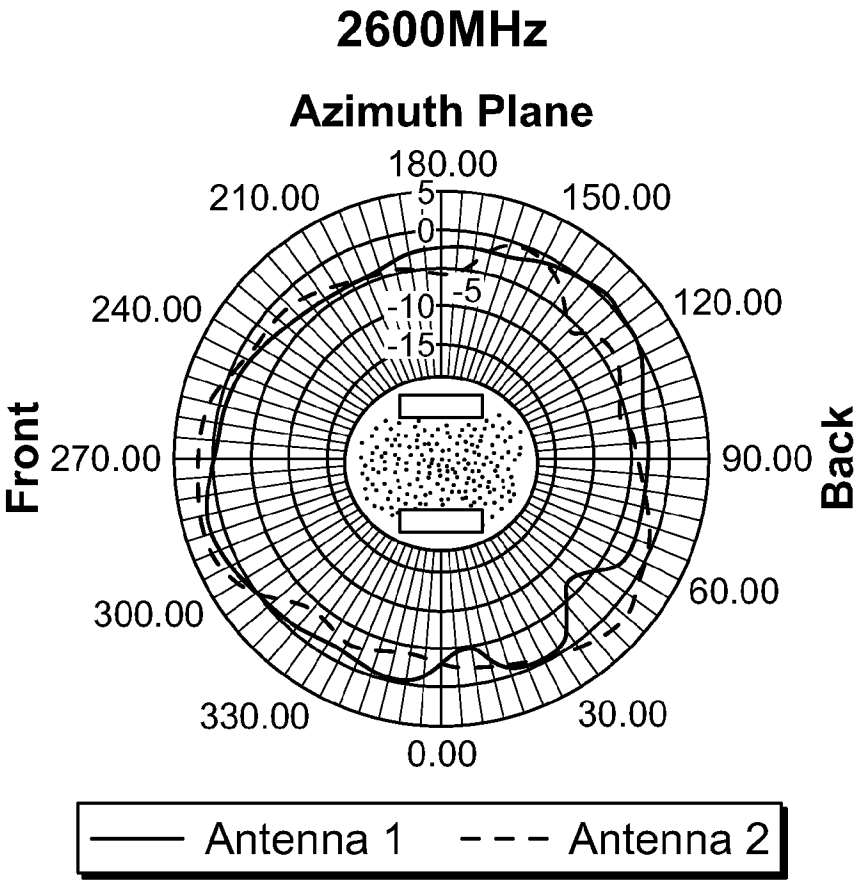
Figure 23:
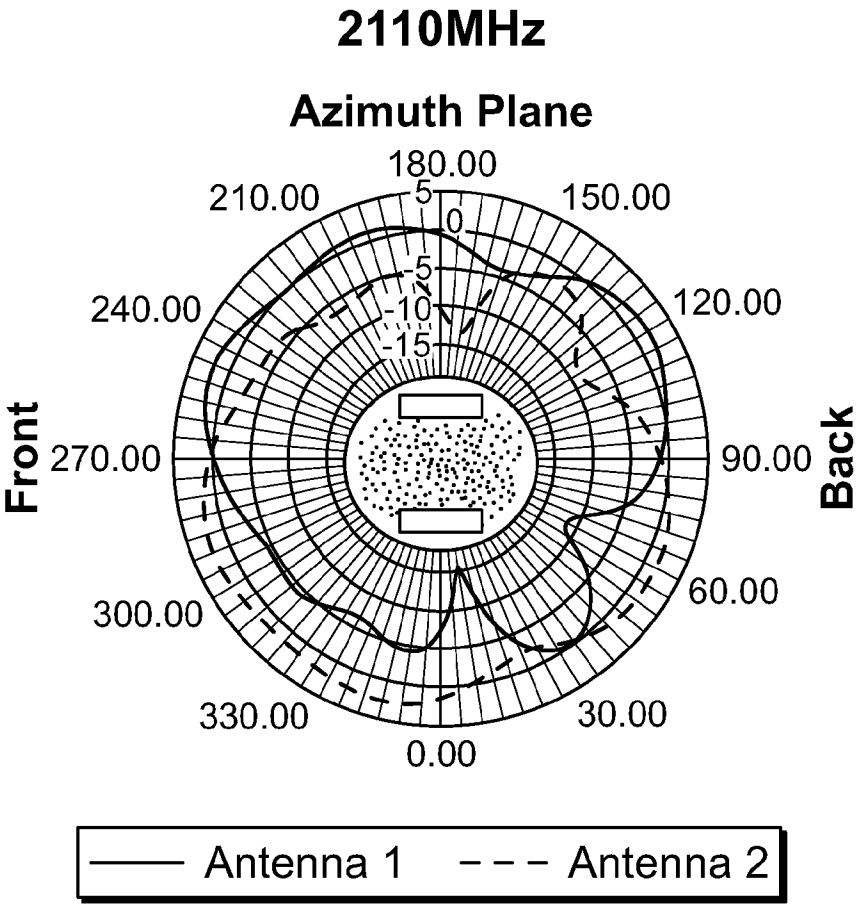
Figure 25:
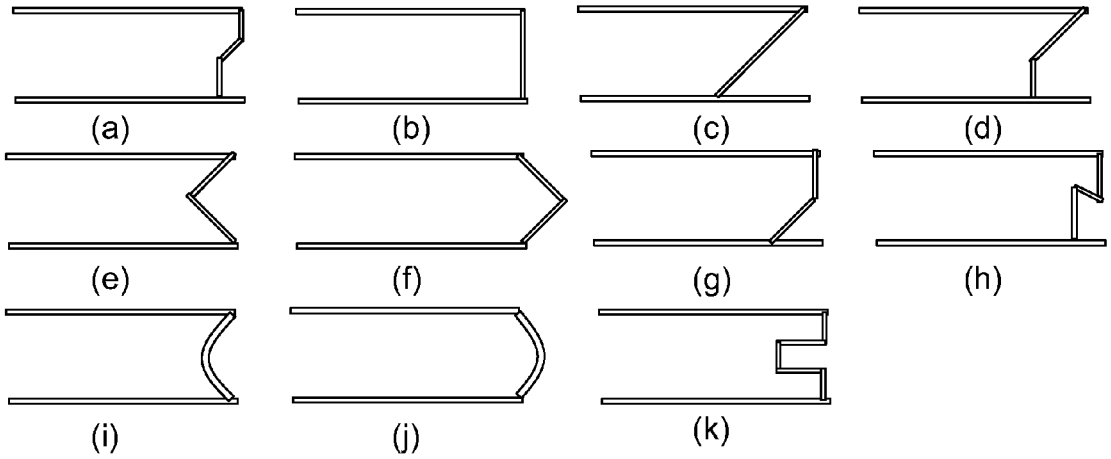
Figure 26:
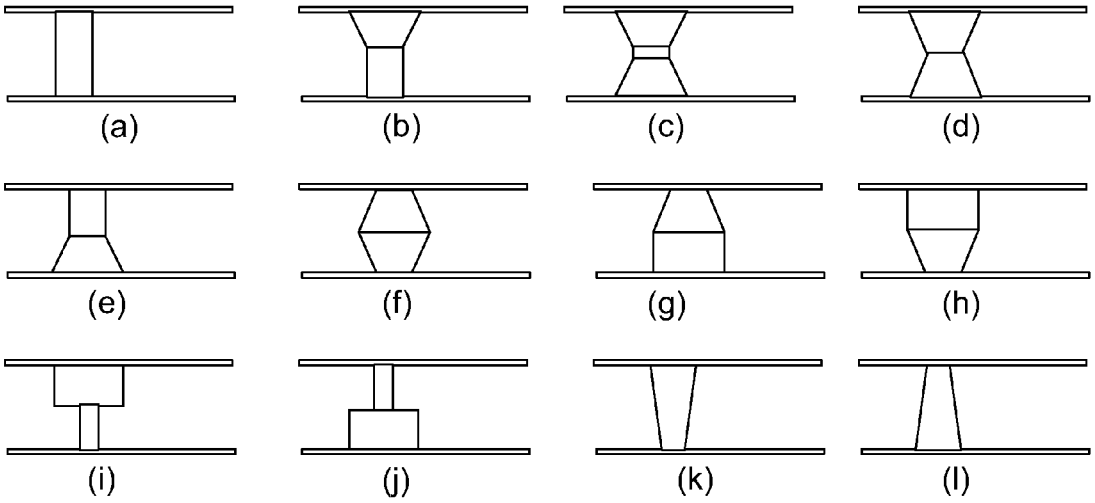
Figure 27:
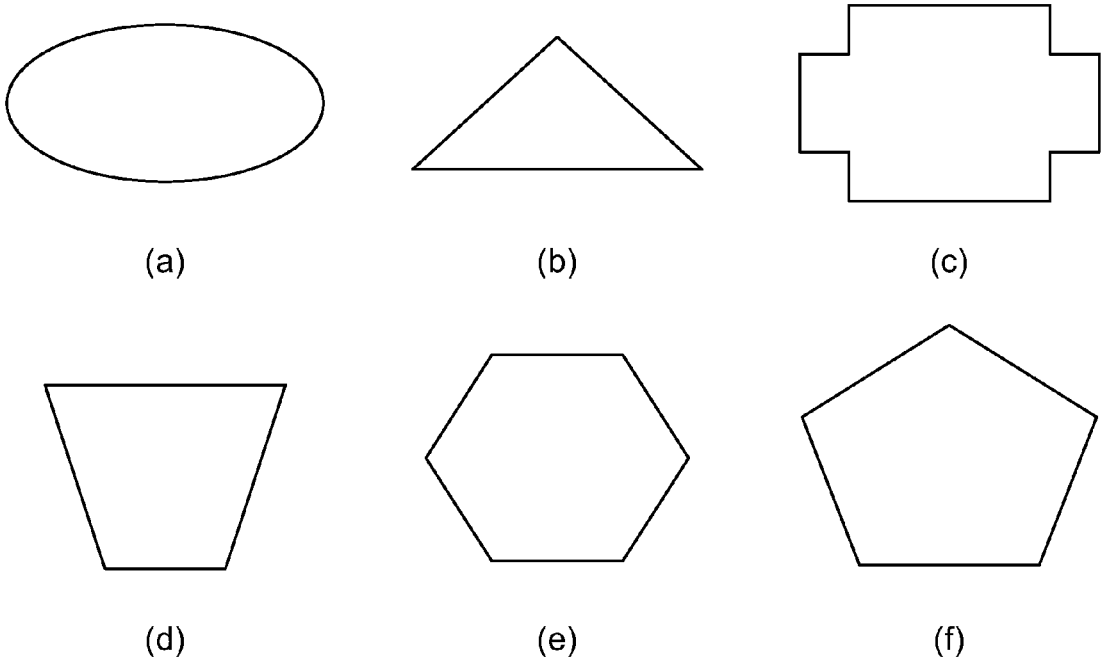
Figure 28:
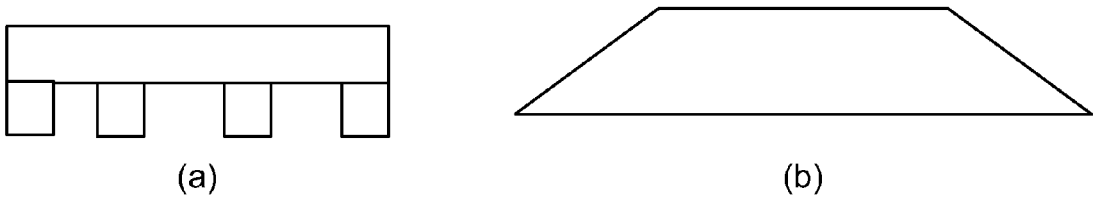
Figure 29:
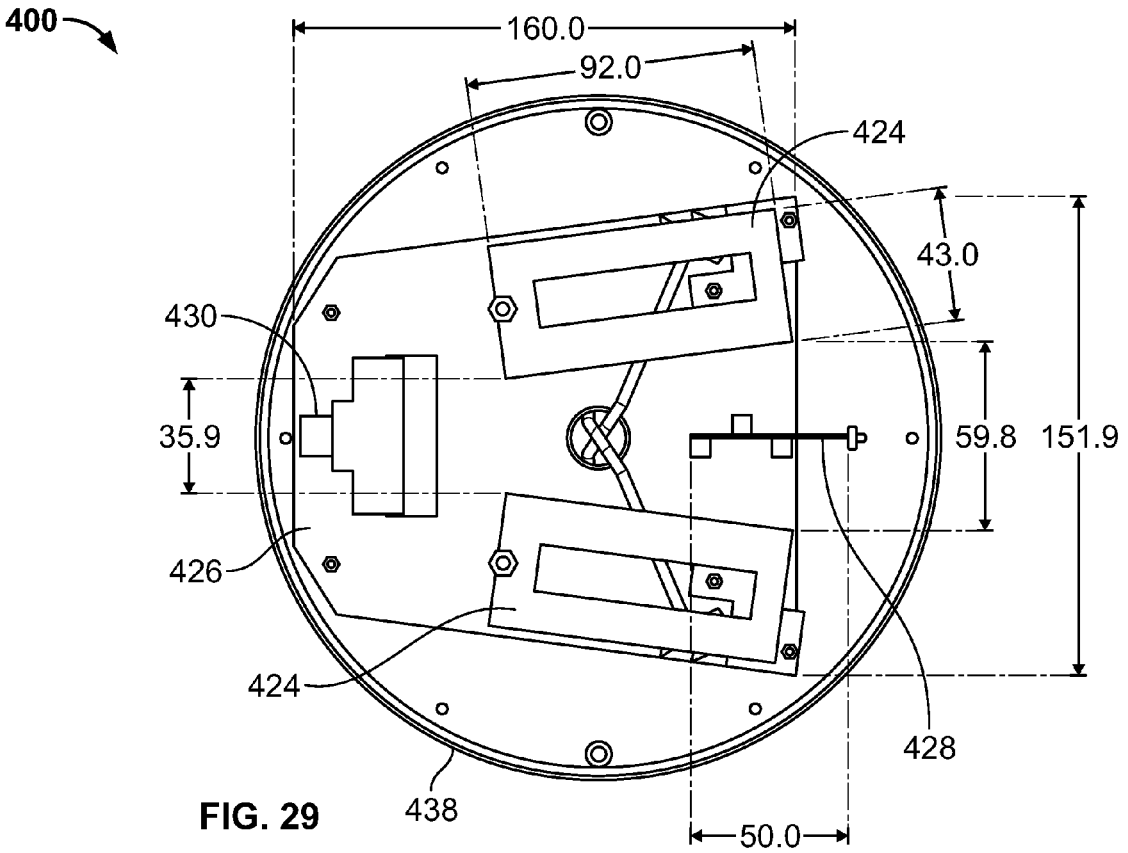
Figure 30:
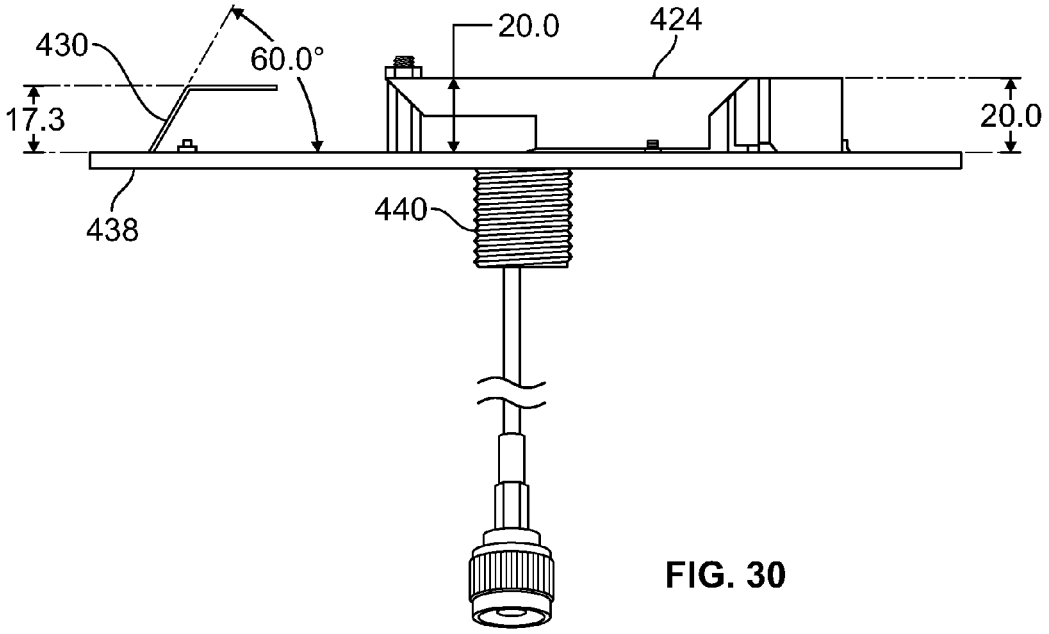

FIG. 8 is an exemplary line graph illustrating Voltage Standing Wave Ratio (VSWR) versus frequency measured for one of two multi-band PIFAs of a prototype similar to the example antenna system shown in FIG. 6, but without the spoiler-shaped isolator for comparison purposes with FIG. 7 to show the improved bandwidth realized by the addition of the spoiler-shaped isolator to the antenna system shown in FIG. 6;

FIG. 9 is an exemplary line graph illustrating isolation in decibels versus frequency between the two multi-band PIFAs of the prototype of the example antenna system shown in FIG. 6;

FIG. 10 is an exemplary line graph illustrating isolation in decibels versus frequency measured between two multi-band PIFAs of a prototype similar to the example antenna system shown in FIG. 6, but without the vertical wall isolator or spoiler-shaped isolator for comparison purposes with FIG. 9 to show the improved isolation realized by the addition of the vertical wall isolator and spoiler-shaped isolator to the antenna system shown in FIG. 6;

FIG. 11 is a perspective view of another exemplary embodiment of an antenna system that includes two multi-band PIFAs as shown in FIG. 2 through FIG. 5, a vertical wall isolator, a spoiler-shaped/T-shaped isolator, and a ground plane dimensionally larger than the ground plane shown in FIG. 6;

FIG. 12 is a partial perspective view of the antenna system shown in FIG. 11, and illustrating the vertical wall isolator;

FIG. 13 is a partial perspective view of the antenna system shown in FIG. 11, and illustrating the second shorting element;

FIG. 14 is a partial perspective view of the antenna system shown in FIG. 11, and illustrating the spoiler-shaped/T-shaped isolator;

FIG. 15 is an exemplary line graph illustrating isolation in decibels versus frequency between the two multi-band PIFAs of the prototype of the example antenna system shown in FIG. 11;

FIG. 16 is an exemplary line graph illustrating isolation in decibels versus frequency measured between two multi-band PIFAs of a prototype similar to the example antenna system shown in FIG. 11, but without the vertical wall isolator or spoiler-shaped isolator for comparison purposes to show the improved isolation realized by the addition of the vertical wall isolator and spoiler-shaped isolator to the antenna system shown in FIG. 11;

FIGS. 17 and 18 are exemplary line graphs illustrating Voltage Standing Wave Ratio (VSWR) versus frequency measured for the first and second multi-band PIFAs, respectively, of the prototype of the example antenna system shown in FIG. 11;

FIGS. 19 through 24 illustrate radiation patterns (azimuth plane) measured for the first and second multi-band PIFAs of the prototype of the example antenna system shown in FIG. 11 at frequencies of about 750 megahertz, 869 megahertz, 1785 megahertz, 1910 megahertz, 2110 megahertz, and 2600 megahertz, respectively;

FIG. 25 are side profile views illustrating differently-shaped shorting elements between a radiating patch element and a lower surface of a multi-band PIFA according to exemplary embodiments;

FIG. 26 are front views of the differently-shaped shorting elements shown in FIG. 25;

FIG. 27 illustrates differently-shaped isolator elements that may be used for a top portion of an isolator in an antenna system that includes multi-band PIFAs according to exemplary embodiments;

FIG. 28 illustrates differently-shaped isolators that may be used between two multi-band PIFAs of an antenna system according to exemplary embodiments;

FIG. 29 is a plan view of an exemplary antenna system mounted on a radome base (the upper housing or radome portion has been removed for clarity) with exemplary dimensions (in millimeters) provided for purposes of illustration only according to exemplary embodiments; and FIG. 30 is a side view of the antenna system and radome base shown in FIG. 29 again with exemplary dimensions (in millimeters) provided for purposes of illustration only according to exemplary embodiments.

DETAILED DESCRIPTION

Example embodiments will now be described more fully with reference to the accompanying drawings.

As described above in the Background, FIG. 1 illustrates a conventional Planar Inverted F-Antenna (PIFA) 10, which includes a radiating patch element 12, a ground plane 14, a shorting element 16, and a feeding element 18. The inventors hereof have recognized that patch antennas are associated with such relatively narrow bandwidths, that the conventional PIFA 10 and its radiating patch element 12 are unable to meet the LTE/4G application bandwidth from 698-960 MHz and from 1710-2700 MHz low profile design.

The inventors hereof disclose exemplary embodiments of multi-band PIFA type antennas (e.g., 100 (FIGS. 2-5), etc.) and antenna systems (e.g., 200 (FIG. 6), 300 (FIG. 11), 400 (FIG. 29), etc.) that include the same, which have improved and/or good isolation. The exemplary embodiments of the inventors' antenna systems are suitable for applications that use more than one antenna, such as LTE/4G applications and/or infrastructure antenna systems (e.g., customer premises equipment (CPE), satellite navigation systems, alarm systems, terminal stations, central stations, in-building antenna systems, etc.).

According to exemplary embodiments, there is disclosed herein a PIFA antenna that includes double shorting and a radiating element with a slot to excite multiple frequencies while enhancing the bandwidth of the antenna. In some embodiments, a multiple antenna system includes two such PIFA antennas that are symmetrically placed relatively close to each other on a ground plane.

The inventors have recognized, however, that isolation between antennas may deteriorate due to mutual coupling between the respective radiating elements of the antennas when antennas are placed close together. The inventors hereof have thus added isolators to their antenna systems such that isolation between the antennas is improved. This isolation improvement allows the inventors to place more antenna radiating elements in the same volume of space. The isolation improvement also allows for a smaller overall antenna assembly, such as for an end use where space is limited or compactness is desired.

Further, the inventors' have disclosed spoiler-shaped isolators that electrically increase the ground surface length, which, in turn, leads to bandwidth improvement especially for low band operations. The large bandwidth associated with exemplary embodiments of the antenna system allows multiple operating bands for wireless communications devices. By way of example, an antenna system having multi-band PIFAs as disclosed herein may be configured to be operable or cover the frequencies or frequency bands listed immediately below in Table 1.

TABLE 1

| Band Number | System/Band Description | Upper Frequency (MHz) | Lower Frequency (MHz) |
|---|---|---|---|
| 1 | 700 MHz Band | 698 | 862 |
| 2 | AMPS/GSM 850 | 824 | 894 |
| 3 | GSM 900 (E-GSM) | 880 | 960 |
| 4 | DCS 1800/GSM 1800 | 1710 | 1880 |
| 5 | PCS 1900 | 1850 | 1990 |
| 6 | W CD MA/UMTS | 1920 | 2170 |
| 7 | 2.3 GHz Band IMT Extension | 2300 | 2400 |
| 8 | IEEE 802.11 B/G | 2400 | 2500 |
| 9 | W IMAX MMDS | 2500 | 2690 |

In exemplary embodiments, an antenna system that includes multi-band PIFAs may be operable for covering all of the above-listed frequency bands with good voltage standing wave ratios (VSWR) and with relatively good efficiency. Alternative embodiments may include an antenna system operable at less than or more than all of the above-identified frequencies and/or be operable at different frequencies than the above-identified frequencies.

Additionally, exemplary embodiments of the inventors' multi-band PIFAs may be formed by using a single stamping. For example, a single piece of material may be stamped and formed (e.g., bent, folded, etc.) to form a PIFA as disclosed herein. In such embodiments, the PIFA may not include any dielectric (e.g., plastic) substrate that mechanically supports or suspends the upper radiating patch element above the lower surface or ground plane of the PIFA. Instead, the upper radiating patch element of the PIFA may be mechanically supported above the lower surface by the PIFA's shorting elements. Accordingly, the PIFA may be considered as having an air-filled substrate or air gap between the upper radiating patch element and lower surface, which allows for cost savings due to the elimination of a dielectric substrate. Alternative embodiments may include a dielectric substrate that supports the upper radiating patch element above the ground plane or lower surface of the PIFA.

With reference now to the figures, FIGS. 2 through 5 illustrate an exemplary embodiment of a multi-band Planar Inverted-F Antenna (PIFA) 100 embodying one or more aspects of the present disclosure. As shown, the driven radiating section of the PIFA 100 includes a radiating patch element 102 (or more broadly, an upper radiating surface or planar radiator).

The radiating patch element 102 includes a slot 104 for forming multiple frequencies (e.g., frequencies from 698 megahertz to 960 megahertz and from 1710 megahertz to 2700 megahertz, etc.) and for frequency tuning at the high band. The slot 104 may be configured such that the PIFA 100 improves the return loss level at high frequencies or high frequency bands for a higher patch. For a lower profile patch option, a slot may not be needed to improve high band in other embodiments. In this illustrated example embodiment, the slot 104 is generally rectangular and divides the radiating patch element 102 so as to configure the PIFA 100 to be resonant or operable in at least a first frequency range and a second frequency range, which is different (e.g., non-overlapping, higher, etc.) than the first frequency range. For example, the first frequency range may be from about 698 megahertz to about 960 megahertz, while the second frequency range is from about 1710 megahertz to about 2700 megahertz. But the slot 104 may be configured for different frequency ranges and/or have any other suitable shape, for example, a line, a curve, a wavy line, a meandering line, multiple intersecting lines, and/or non-linear shapes, etc. without departing from the scope of this disclosure. The slot 104 is an absence of electrically-conductive material in the radiating patch element 102. For example, the radiating patch element 102 may be initially formed with the slot 104, or the slot 104 may be formed by removing electrically-conductive material from the radiating patch element 102, such as etching, cutting, stamping, etc. In still yet other embodiments, the slot 104 may be formed by an electrically nonconductive or dielectric material, which is added to the upper radiating patch element 102 such as by printing, etc.

The radiating patch element 102 is spaced apart from and disposed above a lower surface 106 of the PIFA 100. By way of example only, the radiating patch element 102 may include a top surface that is about 20 millimeters above the bottom of the lower surface (see FIG. 30). This dimension and all other dimensions provided herein are for purposes of illustration only, as other embodiments may be sized differently.

In this example, the radiating patch element 102 and lower surface 106 are rectangular surfaces generally parallel to each other and that are also planar or flat. Alternative embodiments may include different configurations, such as non-planar or non-flat, non-rectangular, and/or non-parallel radiating elements and lower surfaces.

With continued reference to FIGS. 2 through 5, the lower surface 106 of the PIFA 100 may also be considered a ground plane. But depending on the particular end use, the size of the lower surface 106 may be relatively small and of insufficient size for providing a fully effective ground plane. In such embodiments, the lower surface 106 may be used mostly for mechanically attaching the PIFA 100 to a larger ground plane (e.g., ground plane 226 (FIG. 6), 326 (FIG. 11), 426 (FIG. 29), ground plane of a device, etc.) that is sufficiently large enough to provide a fully effective ground plane.

Figure 2:
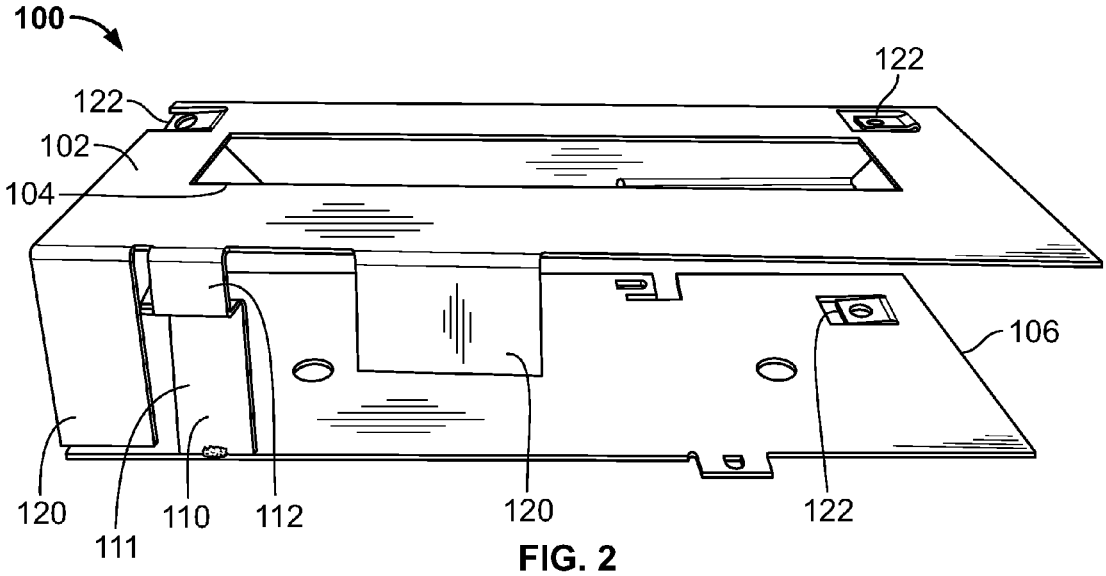
FIG. 2 is a perspective view of a multi-band PIFA according to an exemplary embodiment.

The PIFA 100 also includes a first shorting element 108 (FIG. 4) and a second shorting element 110 (FIG. 2). The first and second shorting elements 108, 110 electrically connect and extend between the radiating patch element 102 and the lower surface 106. In this exemplary embodiment, the first and second shorting elements 108, 110 are electrically connected along the edges of the radiating patch element 102 and lower surface 106. In other embodiments, however, the first and/or second shorting 108, 110 element may be electrically connected to the radiating patch element 102 and/or lower surface 106 at a location inwardly spaced from an edge as shown for the alternative second shorting elements in FIGS. 25(*c*), (*d*), (*e*), (*g*), and (*h*). In addition, the first and second shorting elements 108, 110 may also help mechanically support the radiating patch element 102 above the lower surface 106 of the PIFA 100.

Figure 4:
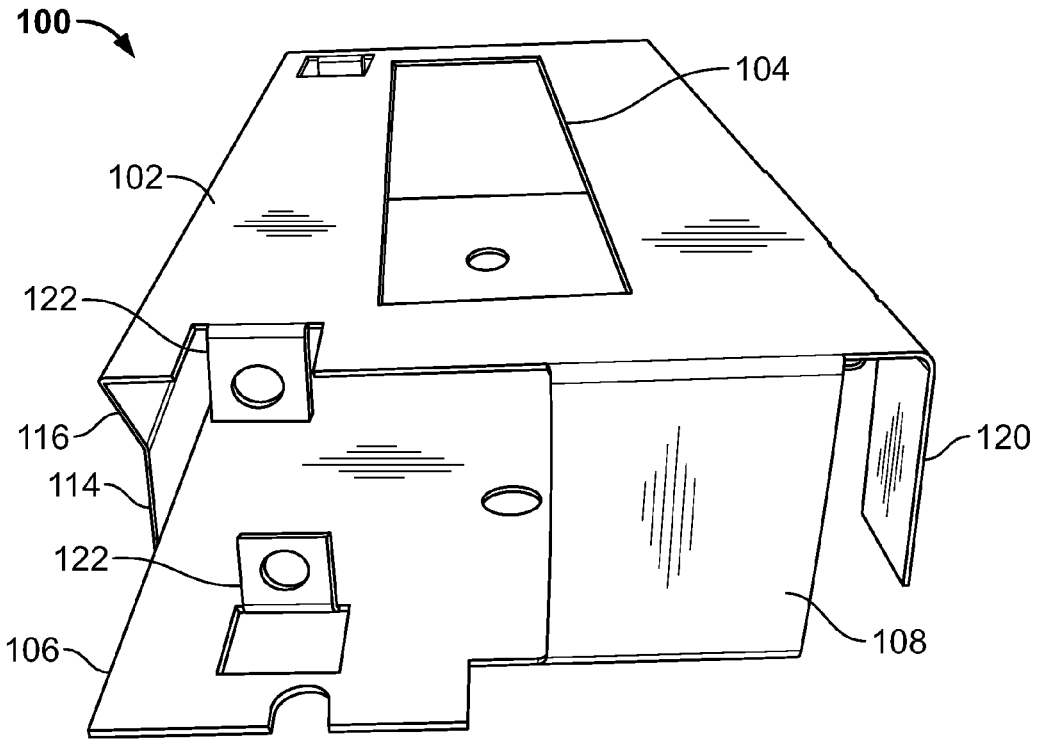
FIG. 4 is a left side perspective view of the multi-band PIFA shown in FIG. 2.

With continued reference to FIG. 4, the first shorting 108 is configured or formed to provide basic PIFA antenna operations or functions. For example, the illustrated first shorting 108 is configured or formed to allow a smaller radiating patch element 102 to be used, e.g., smaller than one-half wavelength patch antenna. By way of example, the radiating patch element 102 may be sized such that the sum of its length and width is about one-fourth wavelength (¼ λ) of a desired resonant frequency.

The second shorting 110 is configured or formed to enhance or improve bandwidth of the PIFA 100 at a first, low frequency range or bandwidth (e.g., frequencies from 698 megahertz to 960 megahertz, etc.). Thus, the second shorting 110 may allow a smaller patch to be used by broadening the bandwidth.

In this particular illustrated embodiment, the first shorting element 108 is generally flat or planar, rectangular, and perpendicular to the upper radiating patch element 102 and lower surface 106. Alternative embodiments may include a first shorting element configured differently than what is illustrated in FIG. 4, such as a non-flat shorting and/or a shorting that is non-perpendicular to the upper radiating patch element and/or lower surface.

The illustrated second shorting element 110 is configured such that it has an overall length greater than the spaced distance or gap separating the radiating patch element 102 and the lower surface 106. In this example, the second shorting element 110 has a non-planar or non-flat configuration. As shown in FIG. 2, the second shorting element 110 includes a first or lower portion 111 that is flat or planar. The first portion 111 is adjacent and perpendicular to the lower surface 106 of the PIFA 100. The second shorting element 110 also includes a second or upper portion 112 adjacent and connected to the radiating patch element 102. The second portion 112 is not co-planar with and protrudes or extends outwardly relative to the first portion 111, thus providing the second shorting element 110 with a three-dimensional, non-flat or non-planar configuration. By way of example, the second portion 112 of the second shorting element 110 may be similar or identical to the non-planar or outwardly protruding portion 312 shown in FIG. 13 (e.g., bent portion, staircase-shaped portion, portion having a step configuration, etc.).

The illustrated first and second shorting elements 108, 110 are but mere examples of possible shapes that may be used for the shorting elements. For example, FIGS. 25 and 26 are side views and front views, respectively, of differently-shaped second shorting elements that may be disposed between a radiating patch element and a lower surface of a PIFA in alternative embodiments. As with the illustrated second shorting element 110, these alternatively shaped second shorting elements may also be operable to enhance the bandwidth of the PIFA 100 at a first, low frequency range or bandwidth (e.g., frequencies from 698 megahertz to 960 megahertz, etc.). For example, FIGS. 25(*b*) and (*c*) illustrate second shorting elements having flat configurations when viewed from the side. Although FIG. 25(*b*) illustrates a second shorting element that is perpendicular to the upper and lower surfaces of the PIFA 100, this second shorting element may have a meandering or non-linear configuration when viewed from the front or back such that its length is greater than the spaced distance or gap separating the PIFA's upper and lower surfaces. Also, FIG. 25(*c*) illustrates a second shorting element non-perpendicular to the upper and lower surfaces of the PIFA, which also has a length greater than the spaced distance or gap separating the PIFA's upper and lower surfaces. The first and second shorting elements should not be limited to only the particular shapes illustrated in the figures.

The PIFA 100 also includes a feeding element 114. The feeding element 114 is electrically connected to and extends between the radiating patch element 102 and the lower surface 106. In this exemplary embodiment, the feeding element 114 is electrically connected to and extends between the edges of the radiating patch element 102 and lower surface 106. In other embodiments, however, the feeding element 114 may be electrically connected to the radiating patch element 102 and/or lower surface 106 of the PIFA 100 at a location inwardly spaced from an edge.

In this example embodiment, the bottom of the feeding element 114 may provide a feeding point 115, for example, for connection to a coaxial cable, transmission line, or other feed. In this illustrated embodiment of the PIFA 100 (FIG. 3), the feeding element 114 is relatively wide as the feeding element 114 may be defined or considered as being the entire illustrated side of the PIFA 100 between the radiating patch element 102 and lower surface 106.

Figure 3:
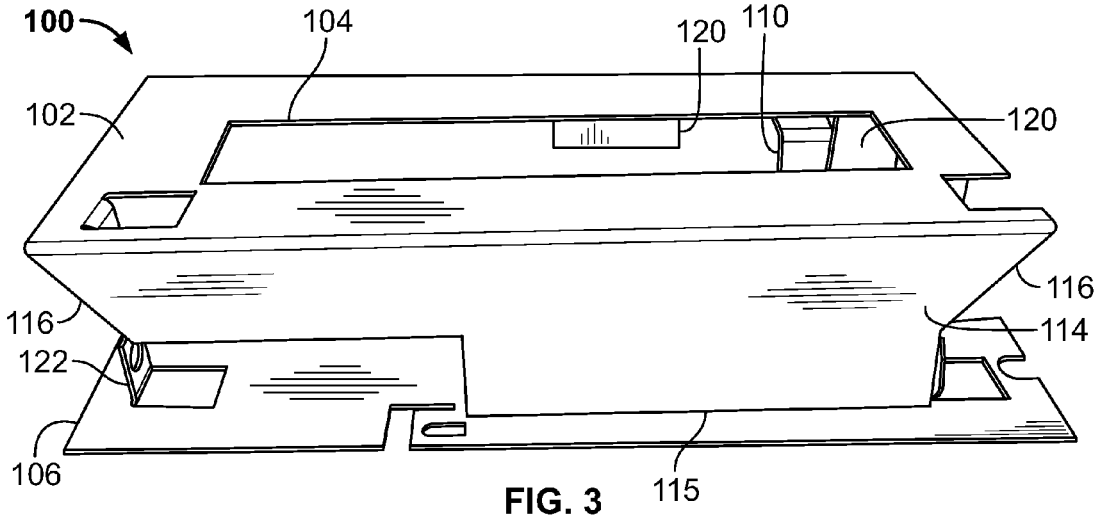
FIG. 3 is a back perspective view of the multi-band PIFA shown in FIG. 2 after the tabs or flaps with the thru-holes have been reconfigured (e.g., folded or bent upwards and downwards, etc.) for attachment of mechanical supports or standoffs.

Also shown in FIG. 3, the feeding element 114 includes tapering features 116 along opposite upper side edge portions of the feeding element 114. The feeding element 114 with the tapering features 116 may be configured for impedance matching purposes that broaden antenna bandwidth, such that the PIFA 100 is operable in at least two frequency bands.

In this illustrated embodiment, the tapering features 116 comprise upper side edge portions of the feeding element 114 that are slanted or angled inwardly towards the middle of feeding element 114. Stated differently, the upper side edge portions 116 of the feeding element 114 are slanted or angled inwardly toward each other along these edge portions 116 in a direction from the radiating patch element 102 downward towards the lower surface 106. Accordingly, the upper portion of the feeding element 114 adjacent and connected to the radiating patch element 102 decreases in width due to the tapering features or inwardly angled upper side edge portions 116. In alternative embodiments, the feeding elements 114 may include only one or no tapering features.

Figure 5:
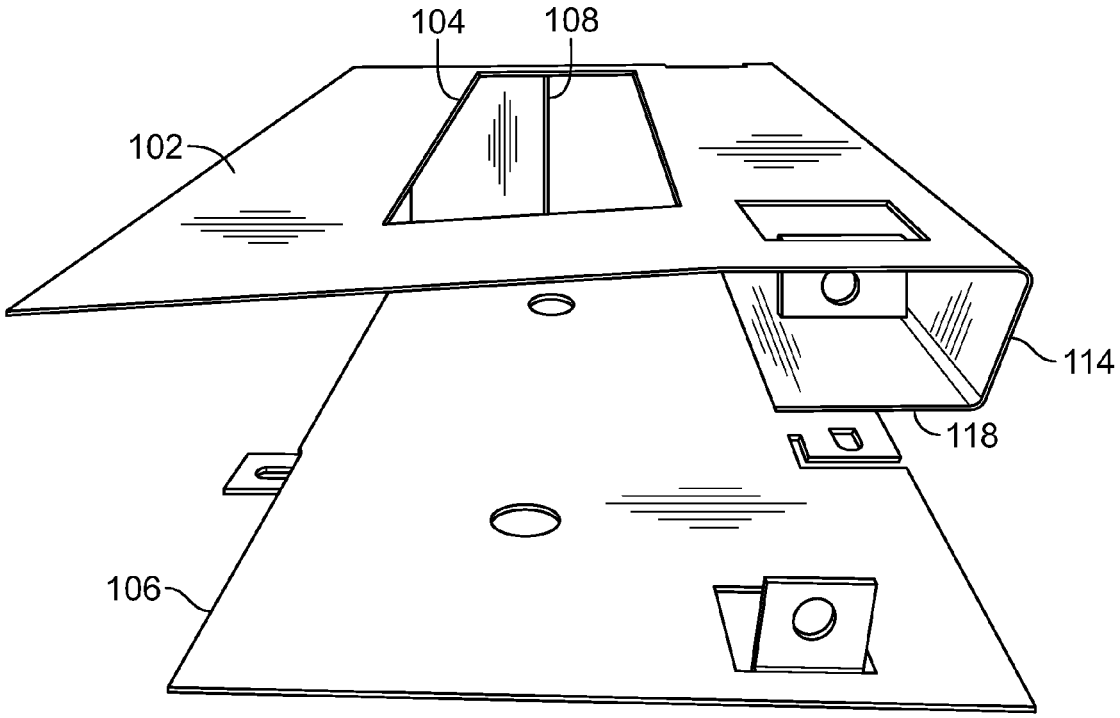
FIG. 5 is a right side perspective view of the multi-band PIFA shown in FIG. 2.

FIG. 5 illustrates a capacitive loading element 118 of the PIFA 100 configured or formed (e.g., bent or folded backwardly, etc.) to provide capacitive loading to widen the bandwidth of the PIFA 100 at a second, high frequency range or bandwidth (e.g., frequencies from 1710 megahertz to 2700 megahertz, etc.). As shown in FIG. 5, the element 118 extends inwardly from the feeding element 114 and is disposed generally between the radiating patch element 102 and lower surface 106 of the PIFA 100. Alternative embodiments may be configured differently (e.g., without the capacitive loading or bend back element, etc.) than what is illustrated in FIG. 5.

As shown in FIG. 2, the illustrated embodiment of the PIFA 100 includes capacitive loading elements or stubs 120 on opposite sides of the second shorting element 110. These elements 120 are configured or formed so as to create capacitive loading for tuning the PIFA 100 to one or more frequencies. For example, the elements 120 may be configured for tuning the PIFA 100 to a first or low frequency range or bandwidth (e.g., frequencies from 698 megahertz to 960 megahertz, etc.) and to a second or high frequency or bandwidth (e.g., frequencies from 1710 megahertz to 2700 megahertz, etc.). Alternative embodiments may be configured differently (e.g., without the capacitive loading elements or stubs, etc.) than what is illustrated in FIG. 2.

Figure 1:
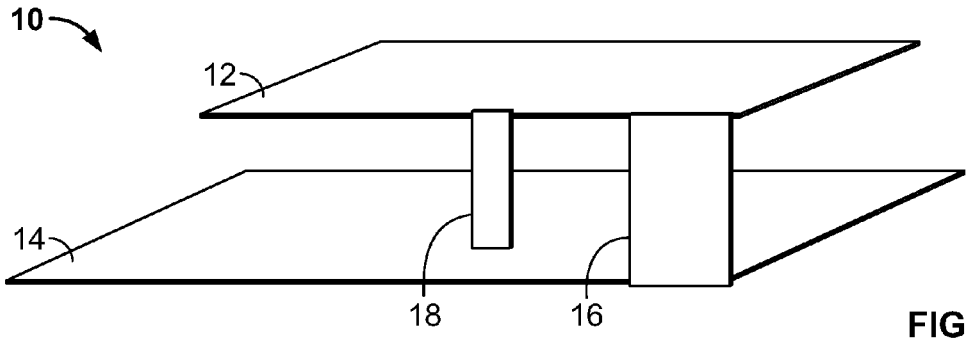
FIG. 1 (Prior Art)
FIG. 1 illustrates a conventional Planar Inverted-F Antenna (PIFA)

The PIFA 100 also includes flaps or tabs 122 with thruholes configured for adding holders, carriers, standoffs, supports, etc. (e.g., standoffs 236 shown in FIG. 6, etc.). For example, standoffs may be positioned or slotted between the radiating patch element 102 and lower surface 106, to physically or mechanically support the radiating patch element 102 with sufficient structural integrity. In FIG. 2, the flaps or tabs 122 are flat or planar surfaces, which are generally parallel with the radiating patch element 102 and lower surface 106. Depending on the particular type of standoffs used, the flaps or tabs 122 may be reconfigured (e.g., folded or bent upwards and downwards, etc.) as shown in FIG. 2. The flaps or tabs 122 may be configured solely for allowing mechanical supports to be added, such that the flaps or tabs 122 do not electrically impact the operation of the PIFA 100. Alternative embodiments may be configured differently (e.g., without the tabs or flaps, etc.) than what is illustrated in FIGS. 1 and 2.

In exemplary embodiments, the inventors' multi-band PIFAs (e.g., PIFA 100 shown in FIGS. 2 through 5, etc.) may be integrally or monolithically formed from a single piece of electrically-conductive material (e.g., copper, gold, silver, alloys, combinations thereof, other electrically-conductive materials, etc.) by stamping and then bending, folding, or otherwise forming the stamped piece of material. The antenna may include an air-filled substrate, which allows for cost savings as compared to PIFAs having a dielectric (e.g., plastic, etc.) substrate. Alternative embodiments may include one or more components or elements that are not integrally formed, but which are separately attached to the PIFA such as by soldering, etc. Also, alternative embodiments may form a PIFA by other manufacturing processes besides stamping, bending, and folding.

An exemplary manufacturing process or method of making the PIFA 100 will now be provided. At a first step, operation, or process, a single piece of material may be stamped so as to create a partial profile for the PIFA 100. The stamped partial profile includes the flat, unfolded, or unbent pattern that includes the radiating patch element 102, slot 104, lower surface 106, shorting elements 108, 110, feeding element 114, capacitive loading element 118, elements or stubs 120, and tabs 122. The pattern stamped into the piece of material will also include the portions of these elements, such as the tapering features 116 of the feeding element 114. This stamping may occur via a single stamping or progressive stamping technique in which the piece of material is fed or advanced through numerous operations of a progressive stamping die in a reciprocating stamping press.

After stamping, the piece of material may be trimmed or cut off to remove excess material. The stamped piece of material may then be formed (e.g., bent, folded, etc.) to provide the PIFA 100 with the configuration shown in FIGS. 2 through 5. For example, the stamped piece of material may be folded or bent such that the radiating patch element 102 and lower surface 106 are generally parallel to each other and connected by the generally perpendicular feeding element 114. Additional folding, bending, or forming operations may be performed in regard to the shorting elements 108, 110 including bending or folding the second shorting element 110 to provide the protruding portion 112. The bottom of the second shorting element 110 may also be galvanically connected (e.g., soldered as shown in FIGS. 2 and 13, etc.) to the lower surface 106 of the PIFA 100. Further folding, bending, or forming operations may also be performed in regard to the capacitive loading element 118, elements or stubs 120, and tabs 122.

FIG. 6 illustrates an exemplary embodiment of an antenna system or assembly 200 embodying one or more aspects of the present disclosure. As shown, the antenna system 200 includes two PIFAs 224 spaced apart from each other on a ground plane 226. The lower surface of each PIFA 224 is mechanically attached (e.g., soldered, etc.) to the ground plane 226. In alternative embodiments, a PIFA may include tabs along the bottom thereof that are configured to be inserted or positioned within slots or holes in the ground plane for aligning and mechanically mounting the PIFA.

In this illustrated embodiment of the antenna system 200, the PIFAs 224 are identical or substantially identical to each other. Also, the PIFAs 224 are identical to or substantially identical to the multi-band, PIFA 100 described herein and shown in FIGS. 2 through 5. In alternative embodiments, the PIFAs 224 may be dissimilar or non-identical, and may be configured differently than the PIFA 100.

The configuration of the ground plane 226 may depend, at least in part, on the particular end use intended for the antenna system 200. Thus, the particular shape, size, and material(s) (e.g., sheet metal, etc.) of the ground plane 226 may be varied or tailored to meet different operational, functional and/or physical requirements. But in view of the relatively small lower surfaces of the PIFAs 224, the ground plane 226 is configured to be sufficiently large enough to be a fully effective ground plane for the antenna system 200.

In the illustrated embodiment of FIG. 6, the ground plane 226 has a rectangular portion 227 and a trapezoidal portion 231. The lower surfaces of the PIFAs 224 are mechanically attached to the rectangular portion 227 in this embodiment. The ground plane 226 may be sized or trimmed so as to fit onto a relatively small radome base (e.g., base 438 shown in FIG. 29, etc.) and so as to fit under an upper radome portion or housing. Alternative embodiments may include differently configured ground planes having other shapes, such as the shape shown in FIG. 11, non-trapezoidal shapes, non-rectangular shapes, entirely rectangular shapes, entirely trapezoidal shapes, etc.

With continued reference to FIG. 6, the antenna assembly 200 includes first and second isolators 228 and 230. The dimensions, shapes, and mounting locations of the isolators 228, 230 relative to the PIFAs 224 may be determined (e.g., optimized, etc.) to improve the isolation and/or to enhance bandwidth.

The first and second isolators 228, 230 may be coupled (e.g., soldered, electrically-conducive adhesive, etc.) to the ground plane 226. As another example, either or both isolators 228, 230 may include tabs along the bottom thereof that are configured to be inserted or positioned within slots or holes in the ground plane 226 for aligning and mechanically mounting the isolators 228, 230.

In this illustrated embodiment, the first isolator 228 comprises a vertical wall isolator similar to or identical to the vertical rectangular wall isolator 328 shown in FIG. 12. Also, the vertical wall isolator 228 may be configured such that its upper, free edge (e.g., 329 shown in FIG. 12) is the same height (e.g., 20 millimeters as shown in FIG. 30, etc.) above the ground plane 226 as the upper surfaces of the radiating patch elements of the PIFAs 224.

Alternative embodiments may include an isolator between the PIFAs 224 that is configured differently (e.g., non-rectangular, non-perpendicular to the ground plane 226, taller or shorter, etc.) than what is illustrated. For example, FIG. 28 illustrates differently-shaped, non-rectangular isolators that may be used as an isolator between two multi-band PIFAs of an antenna system according to exemplary embodiments.

The vertical wall isolator 228 is mounted to the rectangular portion 227 of the ground plane 226 between the PIFAs 224. The vertical wall isolator 228 is generally perpendicular and vertical relative to the ground plane 226. In this particular illustrated embodiment, the PIFAs 224 are spaced equidistant from the vertical wall isolator 228. The PIFAs 224 are symmetrically arranged on opposite sides of the vertical wall isolator 228 about an axis of symmetry through or defined by the vertical wall isolator 228, such that each PIFA 224 is essentially a mirror image of the other.

During operation, the vertical wall isolator 228 improves isolation. The frequency at which the isolator 228 is effective is determined primarily by the length of the horizontal section and height of the isolator 228. The horizontal section is generally parallel to the ground plane 226 in this illustrated embodiment.

With ground planes, the length may be increased or maximized to increase bandwidth. As noted above, however, the ground plane 226 may be sized small enough so that it may be confined within a relatively small radome assembly. For example, an exemplary embodiment may include the ground plane 226 being configured (e.g., shaped and sized) so as to be mounted on the circular radome base 438 (shown in FIG. 29) having a diameter of about 219 millimeters or less.

The inventors hereof recognized that a small ground plane may not have sufficient electrical length for some end use applications. Thus, the inventors added or introduced the second isolator 230 along or adjacent the leading free edge of the trapezoidal portion 231 of the ground plane 226. In use, the second isolator 230 serves the purpose of bandwidth enhancement by increasing the electrical length of the ground plane 226 and improving isolation.

In this illustrated embodiment, the second isolator 230 comprises a T-shaped or spoiler-shaped isolator similar to or identical to the T-shaped/spoiler-shaped isolator 330 shown in FIG. 14. As shown in FIG. 6, the T-shaped or spoiler-shaped isolator 230 includes a first generally rectangular portion 232 extending vertically upwards from and generally perpendicular to the ground plane 226. The isolator 230 also includes a top portion 234 that is generally rectangular and generally parallel to the ground plane 226. The illustrated T-shape or spoiler-shape for the second isolator 230 is but a mere example of a possible shape that may be used for the second isolator 230. For example, FIG. 27 illustrates differently-shaped isolator elements that may be used for a top portion of an isolator in an antenna system that includes multi-band PIFAs according to exemplary embodiments.

The first and second portions 232 and 234 of the isolator 230 are illustrated as being coupled (e.g., soldered, etc.) to each other. The first portion 232 of the isolator 230 is also coupled (e.g., soldered, etc.) to the ground plane 226. In alternative embodiments, the second isolator may be integrally or monolithically formed (e.g., stamped, bent, folded, etc.) from the ground plane as shown in FIG. 11. In such alternative embodiments, soldering of the second isolator 230 may be avoided or eliminated.

The PIFAs 224 include flaps or tabs with thru-holes configured for adding holders, carriers, standoffs, mechanical supports, etc. For example, FIG. 6 illustrates standoffs 236 positioned or slotted between the radiating patch elements and lower surfaces of the PIFAs 224. The standoffs 236 are configured to physically or mechanically support the radiating patch elements with sufficient structural integrity. Alternative embodiments may be configured differently, such as without the standoffs or with different means for supporting the radiating patch elements.

As noted above in regard to FIG. 3, the PIFA 100 includes a feeding element 114. The bottom of the feeding element 114 provides or is operable as the feeding point 115. Likewise, the PIFAs 224 will also include feeding elements and feeding points in the illustrated embodiment of FIG. 6. Also shown in FIG. 6, coaxial cables 238 are connected to the feeding points of the PIFAs 224 for feeding the PIFAs 224. In operation, the feeding points of the PIFAs 224 may receive signals to be radiated by the PIFAs' radiating patch elements from the coaxial cables 238, which signals may be received by the coaxial cables 238 from a transceiver, etc. Conversely, the coaxial cables 238 may receive signals from the feeding points of the PIFAs 224 that were received by the radiating patch elements. Alternative embodiments may include other feeding arrangements or means for feeding the PIFAs 224 besides coaxial cables, such as transmission lines, etc.

FIGS. 7, 8, 9, and 10 illustrate analysis results measured for a prototype of the antenna system 200 shown in FIG. 6. These analysis results shown in FIGS. 7, 8, 9, and 10 are provided only for purposes of illustration and not for purposes of limitation.

More specifically, FIGS. 7 and 8 are exemplary line graphs illustrating Voltage Standing Wave Ratio (VSWR) versus frequency measured for one of the multi-band PIFAs 224 of the prototype with the second, spoiler-shaped isolator 230 (FIG. 7) and without the second, spoiler-shaped isolator 230 (FIG. 8). A comparison of FIGS. 7 and 8 generally show the improved bandwidth realized by the addition of the second, spoiler-shaped isolator 230 to the antenna system 200.

FIGS. 9 and 10 are exemplary line graphs illustrating isolation in decibels versus frequency measured between the two multi-band PIFAs 224 of the prototype of the antenna system 200 with (FIG. 9) and without (FIG. 10) the first, vertical wall isolator 228 and second, spoiler-shaped isolator 230. A comparison of FIGS. 9 and 10 generally show the improved isolation realized by the addition of the first, vertical wall isolator 228 and second, spoiler-shaped isolator 230 to the antenna system 200.

FIG. 11 illustrates another exemplary embodiment of an antenna system or assembly 300 embodying one or more aspects of the present disclosure. The components of the antenna system 300 may be identical or substantially identical to the corresponding components of the antenna system 200 (FIG. 6) except for the differently configured ground planes 226, 326. For example, the ground plane 326 is dimensionally larger than the ground plane 226. Also, the PIFAs 324 and isolators 328, 330 may be identical or substantially identical to the PIFAs 224 and isolators 228, 230 of the antenna system 200.

As shown in FIG. 12, the first isolator 328 of the antenna system 300 comprises a vertical wall isolator having a generally rectangular shape. The vertical wall isolator 328 is mounted (e.g., soldered, etc.) to the ground plane 326 between the two PIFAs 324. The vertical wall isolator 328 is generally perpendicular and vertical relative to the ground plane 326. The vertical wall isolator 328 may be configured such that its upper, free edge 329 is the same height (e.g., 20 millimeters as shown in FIG. 30, etc.) above the ground plane 326 as the upper surfaces of the radiating patch elements of the PIFAs 324.

During operation, the vertical wall isolator 328 improves isolation. The frequency at which the isolator 328 is effective is determined primarily by the length of the horizontal section and height of the isolator 328. The horizontal section of the isolator 328 is generally parallel to the ground plane 326 in this illustrated embodiment.

Alternative embodiments may include an isolator between the PIFAs 324 that is configured differently (e.g., non-rectangular, non-perpendicular to the ground plane 326, taller or shorter, etc.) than what is illustrated. For example, FIG. 28 illustrates differently-shaped, non-rectangular isolators that may be used as an isolator between two multi-band PIFAs of an antenna system according to exemplary embodiments.

FIG. 13 illustrates the second shorting element 310 of one of the PIFAs 324. As shown, the second shorting element 310 includes a protruding or outwardly bent portion 312. The protruding portion 312 provides a three-dimensional or non-flat shape to the second shorting element 310 and also increases its overall length. With the protruding portion 312, the overall length of the second shorting element 310 is greater than the spaced distance or gap separating the PIFA's radiating patch element 302 from the lower surface 306. The second shorting 310 is configured or formed to enhance or improve bandwidth of the PIFA 324 at a first, low frequency range or bandwidth (e.g., frequencies from 698 megahertz to 960 megahertz, etc.), which, in turn, may allow a smaller patch to be used by broadening the bandwidth.

The shape of the second shorting element 310 illustrated in FIG. 13 is a mere example of a possible shape that may be used. For example, FIGS. 25 and 26 are side views and front views, respectively, of differently-shaped shorting elements that may be disposed between a radiating patch element and a lower surface of a multi-band PIFA in alternative embodiments.

As shown in FIG. 14, the second isolator 330 of the antenna system 300 is generally T-shaped or spoiler-shaped. The second isolator 330 includes a first generally rectangular portion 332 extending vertically upwards from and generally perpendicular to the ground plane 326. The isolator 330 also includes a top portion 334 that is generally rectangular and generally parallel to the ground plane 326. The T-shape or spoiler-shape shown in FIG. 14 for the second isolator 330 is a mere example of a possible shape that may be used for the second shorting element 310. For example, FIG. 27 illustrates differently-shaped isolator elements that may be used for a top portion of an isolator in an antenna system that includes multi-band PIFAs according to exemplary embodiments.

FIGS. 15 through 24 illustrate analysis results measured for a prototype of the antenna system 300 shown in FIG. 11. These analysis results shown in FIGS. 15 through 24 are provided only for purposes of illustration and not for purposes of limitation.

More specifically, FIGS. 15 and 16 are exemplary line graphs illustrating isolation in decibels versus frequency measured between the two multi-band PIFAs 324 of the prototype of the antenna system 300 with (FIG. 15) and without (FIG. 16) the first, vertical wall isolator 328 and second, spoiler-shaped isolator 330. A comparison of FIGS. 15 and 16 generally show the improved isolation realized by the addition of the first, vertical wall isolator 328 and second, spoiler-shaped isolator 330 to the antenna system 300.

FIGS. 17 and 18 are exemplary line graphs illustrating Voltage Standing Wave Ratio (VSWR) versus frequency measured for the first PIFA 324 (on the right in FIG. 11) and the second PIFA 324 (on the left in FIG. 11), respectively. Generally, FIGS. 17 and 18 show that the antenna system 300 is operable with good voltage standing wave ratios (VSWR) and with relatively good gain/efficiency.

FIGS. 19 through 24 illustrate radiation patterns (azimuth plane) measured for the first and second PIFAs 324 at frequencies of about 750 megahertz, 869 megahertz, 1785 megahertz, 1910 megahertz, 2110 megahertz, and 2600 megahertz, respectively. Generally, FIGS. 19 through 24 show the radiation pattern for the antenna system 300 (FIG. 11) at these various frequencies and the good efficiency of the antenna system 300. Accordingly, the antenna system 300 has a large bandwidth that allows multiple operating bands for wireless communications devices, including the frequencies or frequency bands listed above in Table 1. In addition, the antenna system 300 of this embodiment also is configured with a linear polarization that is vertical or horizontal depending on the orientation in which the antenna system 300 is mounted.

FIGS. 29 and 30 illustrate an exemplary antenna system 400 that includes PIFAs 424 and isolators 428, 430 on a ground plane 426 similar to the antenna systems 200 (FIG. 6) and 300 (FIG. 11) described above. But in this illustrated embodiment, the antenna system 400 is mounted on a radome base 438 to which would be coupled an upper radome portion or housing (not shown). In the final installation, the upper radome portion or housing would be positioned over the antenna system 400 and coupled to the base 438. Exemplary dimensions (in millimeters) are provided in FIGS. 29 and 30 for purposes of illustration only, as alternative embodiments may include antenna systems sized differently than what is illustrated in FIGS. 29 and 30.

With continued reference to FIGS. 29 and 30, the radome base 438 may have a diameter of about 219 millimeters. In the final installed configuration, the radome assembly may have an overall height of about 43.5 millimeters after the upper radome portion is positioned over the antenna system 400 and attached to the radome base 438.

Also shown in FIG. 30 is a threaded portion 440 protruding outwardly from the radome base 438. The radome assembly and antenna system 400 housed therein may be mounted to a support surface (e.g., ceiling, etc.) by positioning the radome base 438 on one side of the support surface and positioning and threading a nut onto the threaded portion 440 on the opposite side of the support surface.

An antenna system (e.g., 200, 300, 400, etc.) may be configured for use as an omnidirectional MIMO antenna, although aspects of the present disclosure are not limited solely to omnidirectional and/or MIMO antennas. An antenna system (e.g., 200, 300, 400, etc.) disclosed herein may be implemented inside an electronic device, such as a computer, laptop, etc. In which case, the internal antenna components would typically be internal to and covered by the electronic device housing. As another example, the antenna system may instead be housed within a radome, which may have a low profile. In this latter case, the internal antenna components would be housed within and covered by the radome.

A wide range of materials may be used for the components of the antenna systems disclosed herein. By way of example, the PIFAs, isolators, and ground plane may be formed from brass sheet, such as in the exemplary antenna system 300 (FIG. 11). As another example, the PIFAs and isolators may be formed of brass sheet, while the ground plane is formed from sheet metal. In still another embodiment, the ground plane may be formed from two different electrically-conductive materials. For example, rectangular portion 227 of the ground plane 226 illustrated in FIG. 6 may be from sheet metal while the trapezoidal portion 231 is formed from copper. The selection of the particular material, such as brass sheet or sheet metal, may depend on the suitability of the material for soldering, hardness, and costs.

Numerical dimensions and values are provided herein for illustrative purposes only. The particular dimensions and values provided are not intended to limit the scope of the present disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An antenna system operable within at least a first frequency range and a second frequency range different than the first frequency range, the system comprising:

a ground plane;

first and second planar inverted-F antennas (PIFAs), each PIFA including:

a planar radiator having a slot;

a lower surface spaced apart from the planar radiator and mechanically and electrically connected to the ground plane;

a first shorting element electrically connecting the planar radiator to the lower surface;

a second shorting element having a non-flat configuration and electrically connecting the planar radiator to the lower surface; and a feeding element electrically connected to and extending between the planar radiator and the lower surface;

a first isolator disposed between the first and second PIFAs; and a second isolator extending outwardly from the ground plane.

2. The system of claim 1, wherein the first and second PIFAs are symmetrically arranged about and spaced equidistant from opposite sides of the first isolator, and wherein the feeding element of each of said first and second PIFAs is defined as being an entire side of the corresponding first or second PIFA between the upper radiating patch element and the lower surface.

3. The system of claim 1, wherein the second shorting element of each of said first and second PIFAs includes:

a length greater than a spaced distance separating the planar radiator and lower surface; and first and second portions that are not coplanar such that the second portion protrudes or extends generally outwardly away from the first portion thereby providing the second shorting element with a three-dimensional, non-planar or non-flat configuration.

4. The system of claim 1, wherein:

the first isolator includes a vertical wall portion that is generally rectangular and perpendicular to the ground plane, whereby the first isolator is operable for increasing isolation between the first and second PIFAs; and the second isolator has a spoiler-shaped configuration, the second isolator is integrally or monolithically formed from the ground plane, the second isolator including a first portion extending outward at an acute angle from the ground plane and a second portion extending from the first portion generally parallel to the ground plane, whereby the second isolator is operable for increasing the electrical length of the ground plane to enhance bandwidth and to improve isolation; and the ground plane includes a rectangular portion on which are positioned the first and second PIFAs and the first isolator, and a trapezoidal portion from which the second isolator outwardly extends.

5. The system of claim 1, wherein each said first and second PIFA includes a capacitive loading element extending inwardly from the feeding element and disposed with the spaced distance between the planar radiator and lower surface, such that during operation, capacitive loading of the planar radiator with the capacitive loading element allows a wider bandwidth at the second frequency range.

6. The system of claim 1, wherein the feeding element of each of said first and second PIFAs includes upper side edge portions angled inwardly toward each other along the upper side edge portions in a direction from the planar radiator towards the lower surface such that an upper portion of the feeding element adjacent and connected to the planar radiator decreases in width for providing impedance matching.

7. The system of claim 6, wherein the inwardly angled upper side edge portions of the feeding element are configured for providing impedance matching.

8. The system of claim 1, wherein:

the planar radiator of each of said first and second PIFAs comprises an upper radiating patch element; and the second shorting element of each of said first and second PIFAs includes a length greater than a spaced distance separating the planar radiator and lower surface.

9. The system of claim 1, wherein the second shorting element of each of said first and second PIFAs comprises first and second portions where:

the first and second portions are not co-planar with each other, thereby providing the second shorting element with a non-planar configuration by which bandwidth may be enhanced at the first frequency range; and the first portion is generally planar and perpendicular to the lower surface; and the second portion protrudes or extends generally away from the first portion; and the first and second portions provide the second shorting element with a step configuration.

10. The system of claim 1, wherein each of said first and second PIFAs includes:

capacitive loading elements on opposite sides of the first shorting element, the capacitive loading elements configured to create capacitive loading for tuning to the first and second frequency ranges; and tabs having thru-holes for attachment of one or more standoffs between the planar radiator and the lower surface, for mechanically supporting the planar radiator.

11. The system of claim 1, wherein for each of said first and second PIFAs:

the planar radiator is generally rectangular;

the slot is generally rectangular;

the lower surface is generally rectangular, planar, and parallel to the planar radiator; and the first shorting element is generally rectangular, planar, and perpendicular to the planar radiator and the lower surface.

12. The system of claim 1, wherein for each of said first and second PIFAs:

the first and second shorting elements and the slot are configured so as to excite multiple frequencies and enhance bandwidth of the corresponding first or second PIFA; and the first and/or second shorting elements mechanically support the planar radiator above the lower surface; and the lower surface is operable as a ground plane for the corresponding first or second PIFA.

13. The system of claim 1, wherein:

each of said first and second PIFAs is stamped and monolithically formed from a single sheet of material and has a single component structure; and each of said first and second PIFAs is configured to resonate at the first frequency range from about 698 megahertz to about 960 megahertz and at the second frequency range from about 1710 megahertz to about 2700 megahertz; and each said first and second PIFA includes a capacitive loading element extending backwardly and inwardly from the feeding element such that the capacitive loading element is disposed between the planar radiator and the lower surface.

14. The system of claim 1, wherein:

the system further comprises coaxial cables connected to feeding points of the feeding elements of the first and second PIFAs; and the system further comprises one or more standoffs between the planar radiator and lower surface of at least one of said first and second PIFAs, for mechanically supporting the planar radiator; and the first frequency range is from about 698 megahertz to about 960 megahertz and the second frequency range is from about 1710 megahertz to about 2700 megahertz; and the feeding element of each of said first and second PIFAs is defined as being an entire side of the corresponding first or second PIFA between the upper radiating patch element and the lower surface.

15. An infrastructure omnidirectional multiple input multiple output (MIMO) antenna system operable within at least a first frequency range and a second frequency range different than the first frequency range, the system comprising:

a ground plane;

first and second planar inverted-F antennas (PIFAs), each said PIFA includes a lower surface smaller than the ground plane and that is mechanically and electrically connected to the ground plane and a planar radiator spaced apart from the lower surface;

a first isolator including a vertical wall portion disposed between the first and second PIFAs such that the first and second PIFAs are symmetrically arranged about and spaced equidistant from opposite sides of the first isolator; and a second isolator including a first portion extending outwardly at an acute angle from the ground plane and a second portion generally parallel to the ground plane.

16. The system of claim 15, wherein:

the first isolator is configured for increasing isolation between the first and second PIFAs; and the second isolator is integrally or monolithically formed from the ground plane, the second isolator configured to increase the electrical length of the ground plane to enhance bandwidth and to improve isolation.

17. The system of claim 15, wherein:

the vertical wall portion of the first isolator is generally rectangular and perpendicular to the ground plane; and the first and second portions of the second isolator provide the second isolator with a spoiler-shaped configuration; and the ground plane includes a rectangular portion on which are positioned the first and second PIFAs and the first isolator, and a trapezoidal portion from which the first portion of the second isolator outwardly extends.

18. The system of claim 15, wherein each of said first and second PIFAs includes:

a slot in the planar radiator;

a first shorting element electrically connecting the planar radiator to the lower surface;

a second shorting element electrically connecting the planar radiator to the lower surface; and a feeding element electrically connected to and extending between the planar radiator and the lower surface, such that the feeding element is defined as being an entire side of the corresponding first or second PIFA between the planar radiator and the lower surface.

19. The system of claim 18, wherein:

the feeding element of each of said first and second PIFAs includes upper side edge portions angled inwardly toward each other along the upper side edge portions in a direction from the planar radiator towards the lower surface such that an upper portion of the feeding element adjacent and connected to the planar radiator decreases in width for providing impedance matching; and the second shorting element of each of said first and second PIFAs includes a non-flat configuration with a length greater than a spaced distance separating the planar radiator and lower surface; and first and second portions that are not coplanar such that the second portion protrudes or extends generally away from the first portion; and each said first and second PIFA includes a capacitive loading element extending inwardly from the feeding element and disposed with the spaced distance between the planar radiator and lower surface, such that during operation, capacitive loading of the planar radiator with the capacitive loading element allows a wider bandwidth at the second frequency range; and each said first and second PIFA is integrally or monolithically formed from a single sheet of material, such that each said first and second PIFA has a single component structure.

20. The system of claim 15, wherein:

the system further comprises one or more standoffs between the planar radiator and lower surface of at least one of said first and second PIFAs, for mechanically supporting the planar radiator; and the first frequency range is from about 698 megahertz to about 960 megahertz and the second frequency range is from about 1710 megahertz to about 2700 megahertz.

* * * * *